US007901341B2

(12) United States Patent
Shimizu et al.

(10) Patent No.: US 7,901,341 B2
(45) Date of Patent: Mar. 8, 2011

(54) BENDING APPARATUS, METHOD THEREOF, AND BENDING TOOL

(75) Inventors: Masayuki Shimizu, Kanagawa (JP); Hidekatsu Ikeda, Kanagawa (JP); Takanori Okubo, Kanagawa (JP); Akio Kammuri, Kanagawa (JP); Hisashi Uto, Kanagawa (JP)

(73) Assignee: Amada Company, Ltd, Kanagawa (JP)

( * ) Notice: Subject to any disclaimer, the term of this patent is extended or adjusted under 35 U.S.C. 154(b) by 1184 days.

(21) Appl. No.: 10/561,960

(22) PCT Filed: Jun. 22, 2004

(86) PCT No.: PCT/JP2004/009085

§ 371 (c)(1),
(2), (4) Date: May 22, 2006

(87) PCT Pub. No.: WO2004/112981

PCT Pub. Date: Dec. 29, 2004

(65) Prior Publication Data

US 2007/0271987 A1 Nov. 29, 2007

(30) Foreign Application Priority Data

Jun. 23, 2003 (JP) ..... 2003-177586
May 20, 2004 (JP) ..... 2004-151082
Jun. 4, 2004 (JP) ..... 2004-166512

(51) Int. Cl.
*B23Q 3/155* (2006.01)
*B21D 5/00* (2006.01)

(52) U.S. Cl. ..... 483/29; 72/446; 72/478

(58) Field of Classification Search ..... 483/28, 483/29; 72/446, 447, 478
See application file for complete search history.

(56) References Cited

U.S. PATENT DOCUMENTS 4,930,332 A * 6/1990 Hongo ..... 483/28
5,168,745 A * 12/1992 Miyagawa et al. ..... 483/29
5,342,276 A 8/1994 Fujiwara et al.
5,451,195 A 9/1995 Fujiwara et al.
5,882,285 A 3/1999 Seto et al.
5,941,116 A * 8/1999 Kunze ..... 72/306
6,024,681 A * 2/2000 Latten et al. ..... 483/29
6,656,099 B1 12/2003 Akami et al.
6,701,208 B2 3/2004 Hwang (Continued)

FOREIGN PATENT DOCUMENTS

EP 1160024 12/2001

(Continued)

OTHER PUBLICATIONS

Machine Translation of JP 07-100540, which JP '540 was published on Apr. 18, 1995.*

(Continued)

*Primary Examiner* — Erica E Cadugan
(74) *Attorney, Agent, or Firm* — Greenblum & Bernstein, P.L.C.

(57) ABSTRACT

In a bending apparatus which moves one of upper and lower tables (9, 10), and performs bending on a workpiece (W) by tools (P, D) attached to the upper and lower tables (9, 10), a tool group including a plurality of split tools is transferred to the upper and lower table (9, 10), a plurality of process stations are formed by splitting the transferred tool into a plurality of tool groups based on automatically or manually determined tool-layout information, and then bending is carried out.

12 Claims, 34 Drawing Sheets

U.S. PATENT DOCUMENTS

| | | | | |
|---|---|---|---|---|
| 6,937,920 | B2 | 8/2005 | Nishio et al. | |
| 6,959,573 | B2 | 11/2005 | Matsumoto et al. | |
| 2003/0064871 | A1 * | 4/2003 | Akami et al. | 483/1 |

FOREIGN PATENT DOCUMENTS

| | | | | |
|---|---|---|---|---|
| JP | 60-213318 | | | 10/1985 |
| JP | 61-103626 | A | * | 5/1986 |
| JP | 62-057717 | A | * | 3/1987 |
| JP | 05-212447 | A | * | 8/1993 |
| JP | 7-100540 | | | 4/1995 |
| JP | 7-47129 | | | 11/1995 |
| JP | 9-085349 | | | 3/1997 |
| JP | 11-718 | | | 1/1999 |
| JP | 11-010235 | | | 1/1999 |
| JP | 2001-150032 | | | 6/2001 |
| JP | 2003-71519 | | | 3/2003 |
| WO | 00/41824 | | | 7/2000 |

OTHER PUBLICATIONS

Machine translation of JP-11-010235, which JP '235 was published on Jan. 19, 1999.*
English Language Abstract of JP 9-085349.
English Language Abstract of JP 2001-150032.
English Language Abstract of JP 60-213318.
English Language Abstract of JP 11-010235.

* cited by examiner

FIG. 9

| | | a | b | c | |
|---|---|---|---|---|---|
| ① | JUST BEFORE ATTACHMENT | off | off | off | (FIG. 8(A)) |
| ② | TOOL GROUP MOVEMENT (SLIDE) | on | off | off | (FIG. 8(B)) |
| ③ | BENDING (CLAMP) | on | on | off | (FIG. 8(C)) |
| ④ | JUST BEFORE DETACHMENT | off | off | off | (FIG. 8(D)) |

(A)

(B)

LEFTWARD MOVEMETNT OF SEPARATOR

BENDING APPARATUS, METHOD THEREOF, AND BENDING TOOL

TECHNICAL FIELD

The present invention relates to a bending apparatus, method thereof, and a bending tool which improve a process efficiency, and save a tool housing space by coping with step bending easily and rapidly.

BACKGROUND ART

Conventional tool exchangers in press brakes are disclosed by, for example, Unexamined Japanese Patent Application KOKAI (laid open) Publication No. H9-85849, Unexamined Japanese Patent Application KOKAI (laid open) Publication No. 2001-150032, and PCT International Publication No. WO00/41824.

Among those exchangers, one disclosed by Unexamined Japanese Patent Application KOKAI (laid open) Publication No. H9-85349 is provided with a plurality of center tools whose lengths are increased by, for example, 5 mm pitch per tool and which is housed in a tool cartridge on the center of an upper table (for example, FIG. 2 of this publication).

According to this structure, as a center tool with a predetermined length is selected from the tool cartridge, and split tools slidable rightward and leftward are gathered in the center tool, a process station which has a tool layout with a predetermined length is built.

The tool exchanger of the Unexamined Japanese Patent Application KOKAI (laid open) Publication No. 2001-150032 provides tool racks on both sides of a press brake main body (for example, FIG. 1 of this publication), and one tool rack houses a tool group undergone layout beforehand.

According to this structure, after a process is finished, a used tool is removed from the press brake main body and transferred to the other tool rack, and the tool group undergone layout as explained above is transferred from one tool rack to the press brake main body and attached to it.

The tool exchanger of PCT International Publication No. WO00/41824 is provided with a cartridge which houses split tools of different lengths on one side of a press brake main body (for example, FIG. 23 of this publication).

According to this structure, a tool group which combines tools of various lengths are automatically made, transferred to the press brake main body each making, and a process station with a predetermined tool layout is built.

The tool exchanger of Unexamined Japanese Patent Application KOKAI (laid open) Publication No. H9-85349 has the single process station, and is suitable for a center bend process which performs process at the center of the upper and lower tables, but may not accept step bending.

That is, as illustrated in FIG. 33 of this application, in the case of step bending in which a workpiece W is transferred to a plurality of different process stations st1, st2, st3 with respect to each bending order to do process, such step bending may not be acceptable if the tool cartridge at the center of the upper table shown by Unexamined Japanese Patent Application KOKAI (laid open) Publication No. H9-85349 houses plenty kinds of center tools.

Because the tool exchanger of Unexamined Japanese Patent Application KOKAI (laid open) Publication No. 2001-150032 is, as explained above, provided with the tool racks on both sides of the press brake main body, the press brake becomes wide transversally by just that much, and an extra housing space becomes necessary, and a worker may insert an incorrect-layout tool group into one mold rack, and in this case, a desired bending becomes impossible, and a process efficiency is remarkably decreased.

Further, as explained above, the tool exchanger of PCT International Publication No. WO00/41824 combines split tools of different lengths, and builds a plurality of process stations, but in a case where the number of tools of the same length is insufficient, step bending may not be carried out easily and rapidly.

For example, as illustrated in FIG. 34 of this application, in a case where four tools pA, dA with lengths of 10 mm are required at a process station stA but one of them is lacked and there is no spare in the housing cartridge, after a process at a process station stB is finished, tool pB, dB used at the process station stB with lengths of 10 mm should be transferred to the process station stA to do process.

Moreover, because PCT International Publication No. WO00/41824 creates a tool layout with reference to the length of the tool (FIG. 46 of this publication), it requires complex calculation, and also requires a lot of time for tool-layout creation, and it cannot rapidly cope with step bending.

In Japanese Patent Application No. 2008-177586 (filed in June 23, Heisei 15) which is the basic application of this application, a tool group is constituted by split tools with the same length, and a plurality of process stations are formed to cope with a predetermined bending length, but in this method, in a case where the lengths of the process stations are longer than or equal to a certain length, the number of tools becomes large, a lots of scratches are formed on a workpiece among the individual split tools, and particularly, this becomes a problem for a product which requires an appearance quality.

To overcome this problem, process is carried out with a film-like scratch prevention sheet being attached to the surface of a workpiece, but it requires attachment and removal of the sheet before and after the process, and this causes increment of entire process time, resulting in being unable to cope with step bending easily and rapidly, reducing a process efficiency, and increment of a coat.

The object of the invention is to improve a process efficiency and save a tool-housing space in a bending apparatus by coping with step bending easily and rapidly.

DISCLOSURE OF INVENTION

To achieve the object, provided by the invention are, a bending apparatus which moves one of upper and lower tables 9, 10, and performs bending on a workpiece W with tools P, D attached to the upper and lower tables 9, 10, which comprises:

tool-layout information determination device for automatically or manually determining tool-layout information based on product information;

tool housing device A, A' for housing a tool group including a plurality of split tools;

tool exchanging device B, B' for exchanging tool groups between the tool housing device A, A', and the upper and lower tables 9, 10; and process-station formation device C for splitting a tool group transferred from the tool housing device A, A' to the upper and lower tables 9, 10 through the tool exchanging device B, B' into a plurality of tool groups based on the tool-layout information from the tool-layout information determination device, thereby forming a plurality of process stations (FIG. 1), a bending method in a bending apparatus which moves one of upper and lower tables 9, 10, and performs bending on a workpiece W with tools P, D attached to the upper and lower tables 9, 10, forming a process station by isometric split tools based on automatically or manually determined tool-layout information, and then performing bending, a bending method in a bending apparatus which moves one of upper and lower tables 9, 10, and performs bending on a workpiece W with tools P, D attached to the upper and lower tables 9, 10, forming a plurality of process station by transferring a tool group which comprises a plurality of split tools to upper and lower tables 9, 10, splitting the transferred tool group into a plurality of tool groups based on automatically or manually determined tool-layout information, and then performing bending, and a bending tool in a bending apparatus which moves one of upper and lower tables 9, 10, and performs bending on a workpiece W with tools attached to the upper and lower tables 9, 10, provided with a groove 55 with which tool moving and positioning device R for moving and positioning the bending tool in a longitudinal direction (X-axial direction) of the upper and lower tables can be engaged (FIG. 32).

According to the structure of the invention, a predetermined number N (for example, 250) of tools having the same shape (for example, straight sword type) and the same length (for example, 5 mm) defines one mold group, and a plurality of tool groups G1 to G4, G1' to G4' are housed, desired tool groups G3, G3' (FIG. 16(A)), each comprising punches P and dies D selected from the plurality of tool groups, are transferred to upper and lower tables 9, 10 side, and when a process station is formed, for example, because a separator 60 (FIG. 14) sorts and splits the tool groups into a plurality of tool groups g1 to g4, g1' to g4' with reference to the number of tools n1, n2, e.g., at each punches P side and dies D side, and positions them at predetermined positions (FIG. 16(D)), the number of tools with the same length does not lack, and creation of a tool layout with reference to the number of tools facilitates building a plurality of process stations for different processes, and this makes it possible to cope with step bending easily and rapidly.

According to the structure of the invention, since a tool E1 (FIG. 26(A)) comprising a plurality of spilt tools P with different shapes (for example, straight-sword type, goose-neck type), and different lengths (for example, 5 mm, 30 mm, and 50 mm) are housed, in a case where a process station is determined to cope with step bending easily and rapidly for a product particularly requiring a quality, a tool having a length close to the length of the process station is preferentially selected, and the process station with that length is constituted by less split tools as much as possible, thereby preventing formation of a scratch in a workpiece at the time of bending.

According to the structure of the invention, because the plurality of tool groups G1 to G4, G1' to G4' are housed in multiple racks on the rear faces of the upper and lower tables 9, 10 (for example, first racks 22, 23 to fourth racks 28, 29 provided up and down (in Z-axial direction) of the rear face of the upper table 9 in FIG. 8) at each punches P side (FIG. 1) and dies D side, it is possible to save a tool housing space.

Further, according to the structure of the invention, formation of a tool group by split tools all having lengths of 5 mm (FIG. 31, FIG. 32) makes it possible to cope with various bending lengths without using a lacking 15 mm split tool, resulting in rapid building of the plurality of process stations, and in view of this point, it is possible to cope with step bending easily and rapidly.

Therefore, the invention enables a bending apparatus to improve a process efficient and save a tool housing space by easily and rapidly coping with step bending.

BRIEF DESCRIPTION OF DRAWINGS

FIG. 9 is an explanatory diagram of the states of a drive source in the case of FIG. 8.

BEST MODE FOR CARRYING OUT THE INVENTION

Embodiments of the invention will be explained below with reference to the accompanying drawings.

Figure 1:
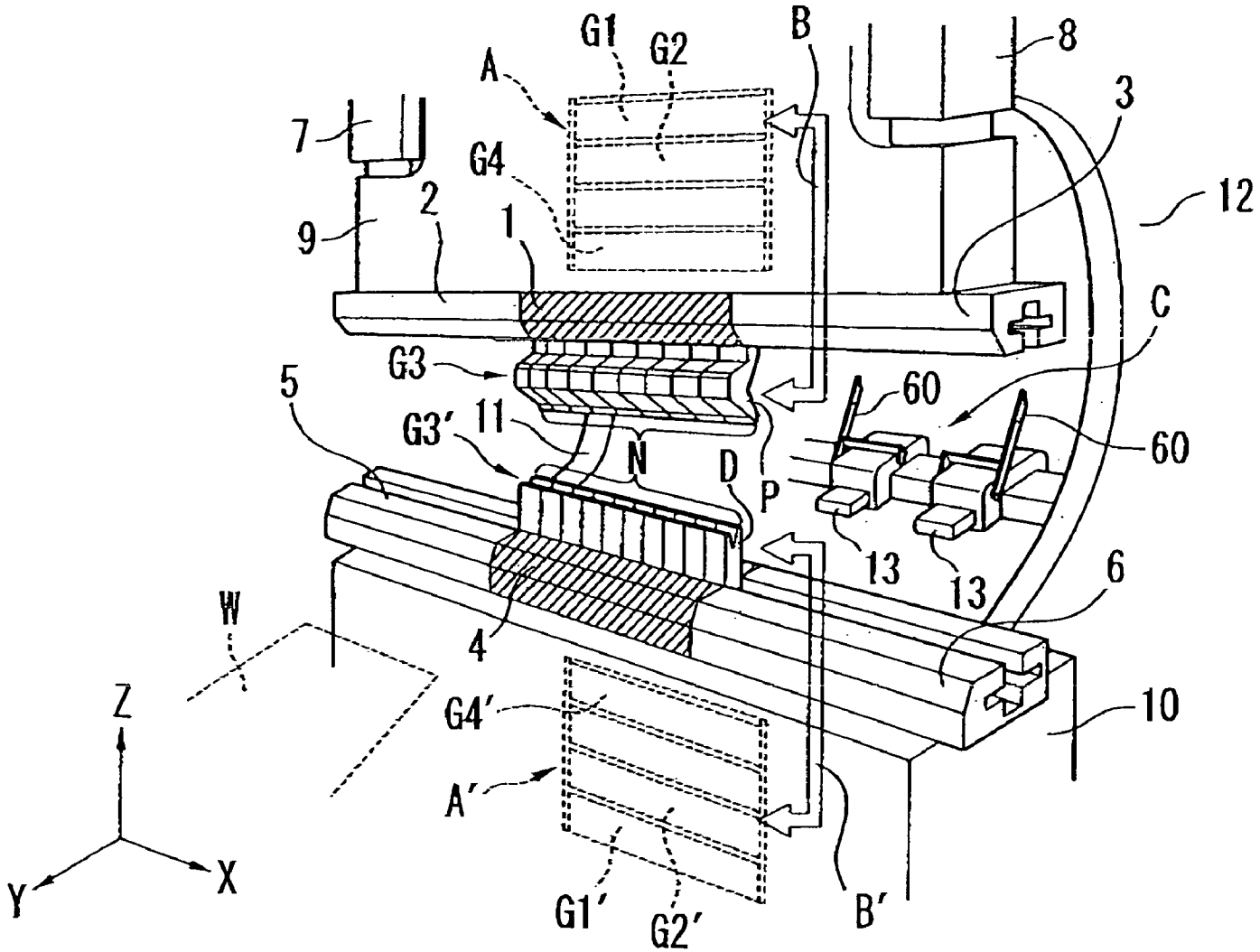
FIG. 1 is a general perspective view illustrating an embodiment of the invention.
Figure 33:
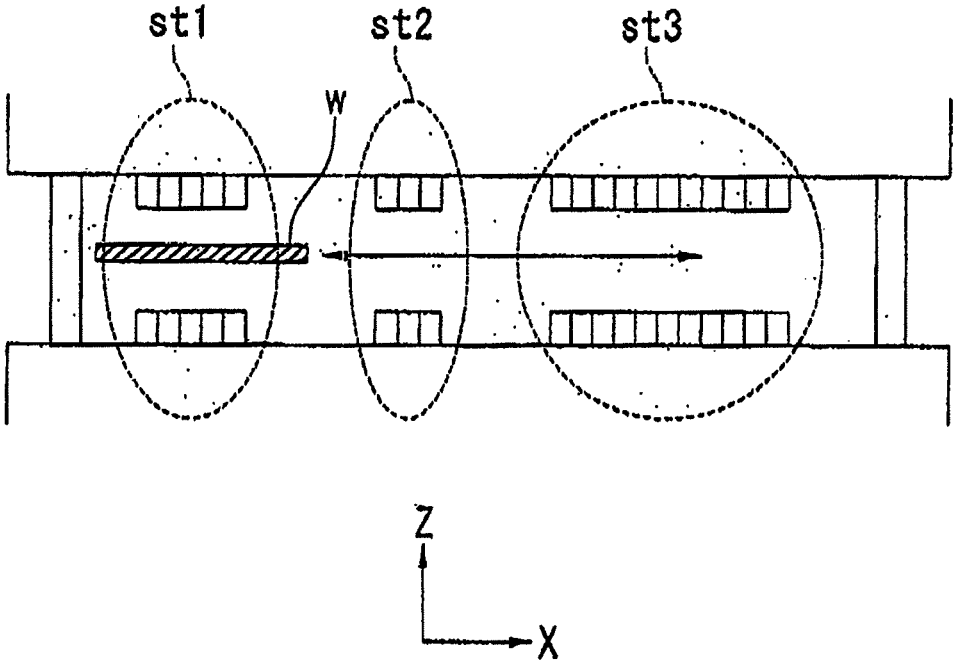
FIG. 33 PRIOR ART
FIG. 33 is an explanatory diagram of the problem of Unexamined Japanese Patent Application KOKAI (laid open) Publication No. H9-85349.
Figure 34:
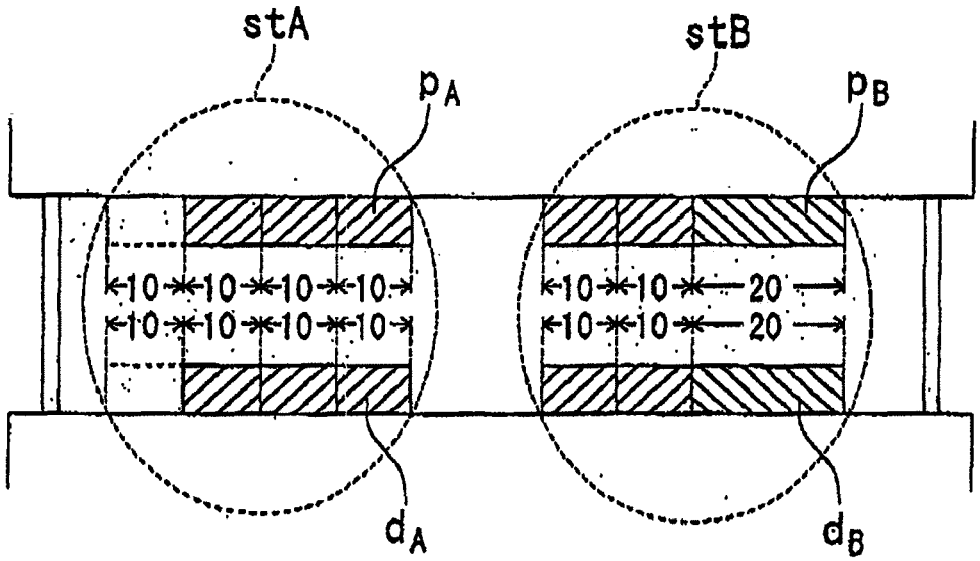
FIG. 34 PRIOR ART
FIG. 34 is an explanatory diagram of the problem of PCT International Publication No. WO00/41824.

FIG. 1 is a general perspective view illustrating an embodiment of the invention, Recently, the shapes of products nowadays become complex, so that step bending (for example, FIG. 33) in which a plurality of process stations are formed in a bending apparatus, and a workpiece is transferred to the individual process stations by bending orders to be processed has become a mainstream.

To cope with the process station, the invention sequentially checks interference between a tool and a workpiece based on product information (for example, CAD information) and automatically determines bending orders and a combination of split tools to be used for each bending order and their layout (tool-layout (process station) information regarding which tool is to be laid out and at which position that tool is to be laid out to the right and left of a table of the bending apparatus), or determines the tool-layout information by manually specifying it using the operation screen of the bending apparatus (depending on the experience of a worker at a site).

In this case, as explained above, the tool-layout information is automatically or manually determined based on the product information, and for example, an NC apparatus is automatic tool-layout information determination device, and, for example, the above-described operation screen is manual tool-information determination device.

Based on the tool-layout information determined in this manner, a desired process station of the following mode can be formed.

A bending apparatus in FIG. 1 is, for example, a lifting-down type press brake, and when hydraulic cylinders 7, 8 attached to the upper parts of both side plates 11, 12 are actuated, an upper table 9 is lowered, and bending is performed on a workpiece W by punches P attached to the upper table 9, and dies D attached to a lower table 10 directly under the punches.

Attached to the centers of the upper and lower tables 9, 10 are freely attachable/detachable tool holders 1, 4 to whose both sides fixed tool holders 2, 3 and 5, 6 are respectively attached, and tools comprising the punches P and the dies D are attached through those tool holders.

In this case, holder clamp members 46, 46' which fix the freely attachable/detachable tool holders 1, 4 are embedded in the centers of the upper and lower tables 9, 10.

Figure 2:
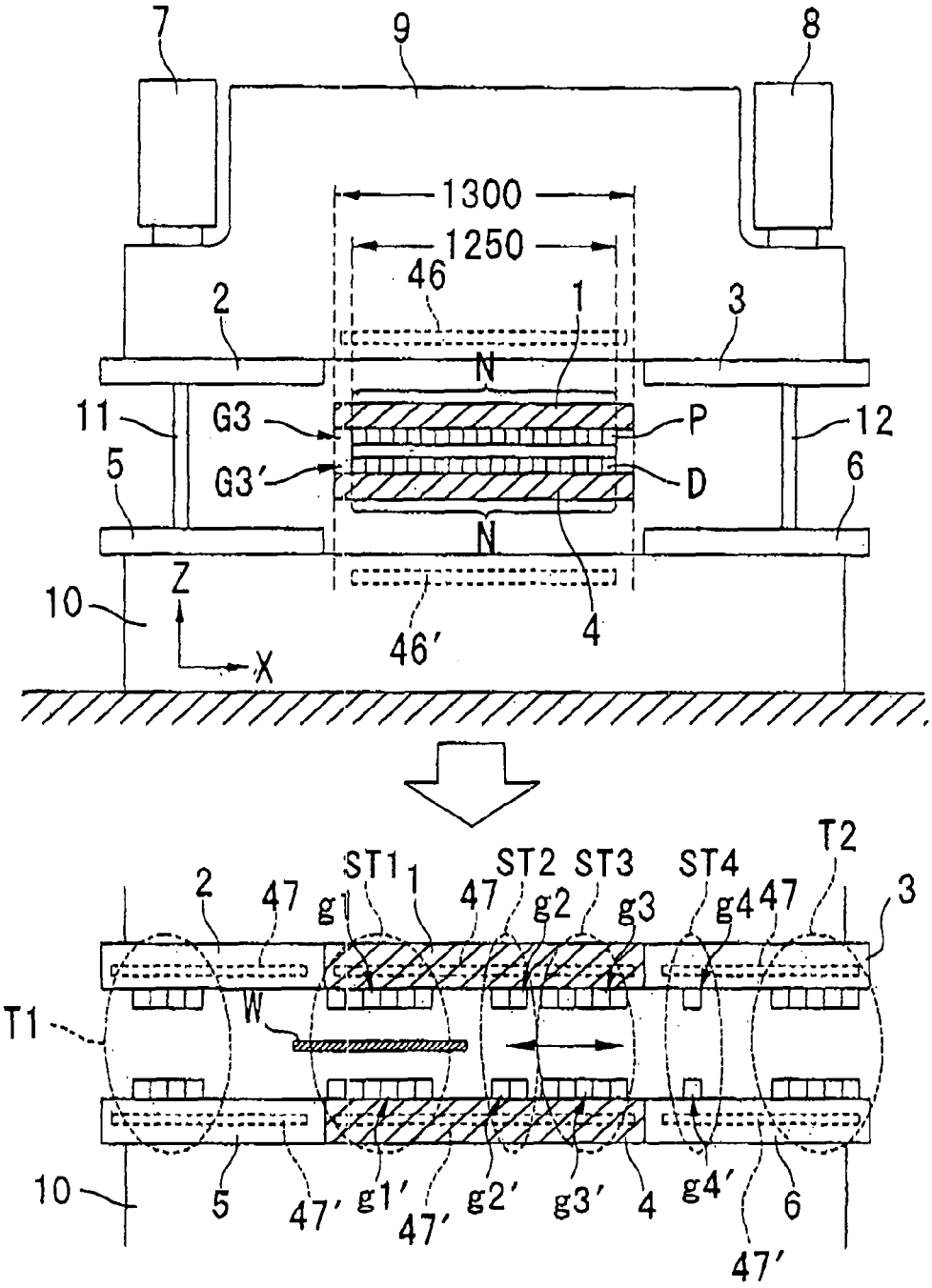
FIG. 2 is a front view of the invention.

Tool clamp members 47, 47' which support and fix the tool are embedded in the freely attachable/detachable tool holders 1, 4, and the fixed tool holders 2, 3 and 5, 6 (lower figure in FIG. 2).

The tool clamp members 47, 47' are operated with, for example, hinge members 40 (FIG. 7) to be discussed later, and support the tool to prevent the mold from falling at a normal time (for example, FIG. 8(A)).

The tool clamp members 47 (lower figure in FIG. 2), 47' support the mold in such a way that the tool is movable rightward and leftward (X-axial direction) (for example, FIG. 8(B)) at the time of process-station formation to be discussed later, and fix the tool at a predetermined position (for example, FIG. 8(C)) after the formation of the process station.

Further, at the time of forming process-stations ST1, ST2, ST3, and ST4 (lower figure in FIG. 2), the tool is movable in rightward and leftward as explained above, over the entire regions of the freely attachable/detachable tool holders 1, 4, and the fixed tool holders 2, 3, and 5, 6. Therefore, the invention can build a relatively long process station and multiple process stations.

If there is any excess tool not to be used, however, it is possible to set both end sections as retraction positions T1, T2, as illustrated in the figure, and retract the unused tool at the retraction position T1 or T2.

Figure 19:
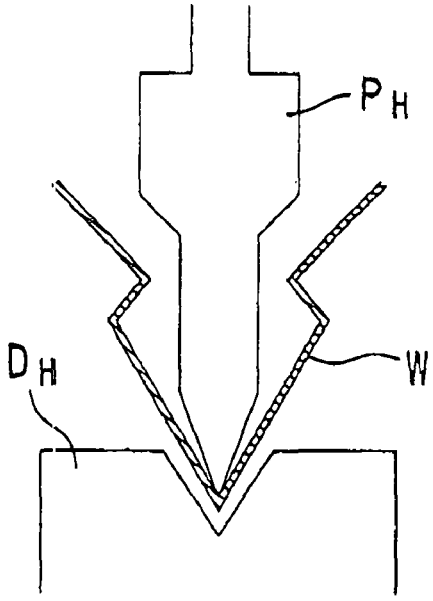
FIG. 19 is an explanatory diagram of the shape of the tool used by the invention.
Figure 19:
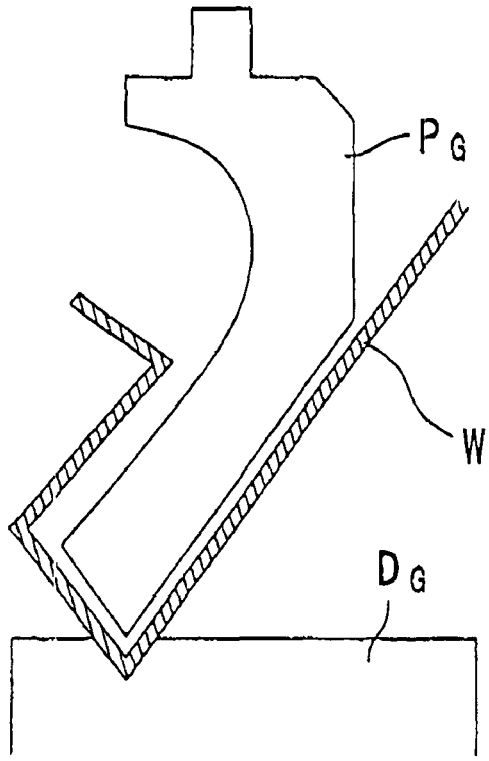

The central tool holders 1 (upper figure in FIG. 2), 4 are provided with a predetermined number N (for example, 250) of tools P, D (split molds) which have the same shape (for example, straight-sword type (FIG. 19(A)), and the same length (for example, 5 mm).

The invention has tool housing device A, A' (FIG. 1) which house the tool holders 1, 4 (the total length being 1300 mm (upper figure in FIG. 2)) including a plurality of tool groups G1 to G4, G1' to G4', (FIG. 1) whole with the predetermined number N of such tools having the same shape and the same length (the total length being 1250 mm=5 mm×250 (upper figure in FIG. 2), the above-described tool exchanging device B, B', and process-station formation device C.

In this case, the tool housing device A, A' (FIG. 1) and the tool exchanging device B, B' have the same structure at the punch P side and the die D side, and an explanation will now be given mainly of the punch P side in detail. The process-station formation device C is shared by the punches P side and the dies D side.

Figure 3:
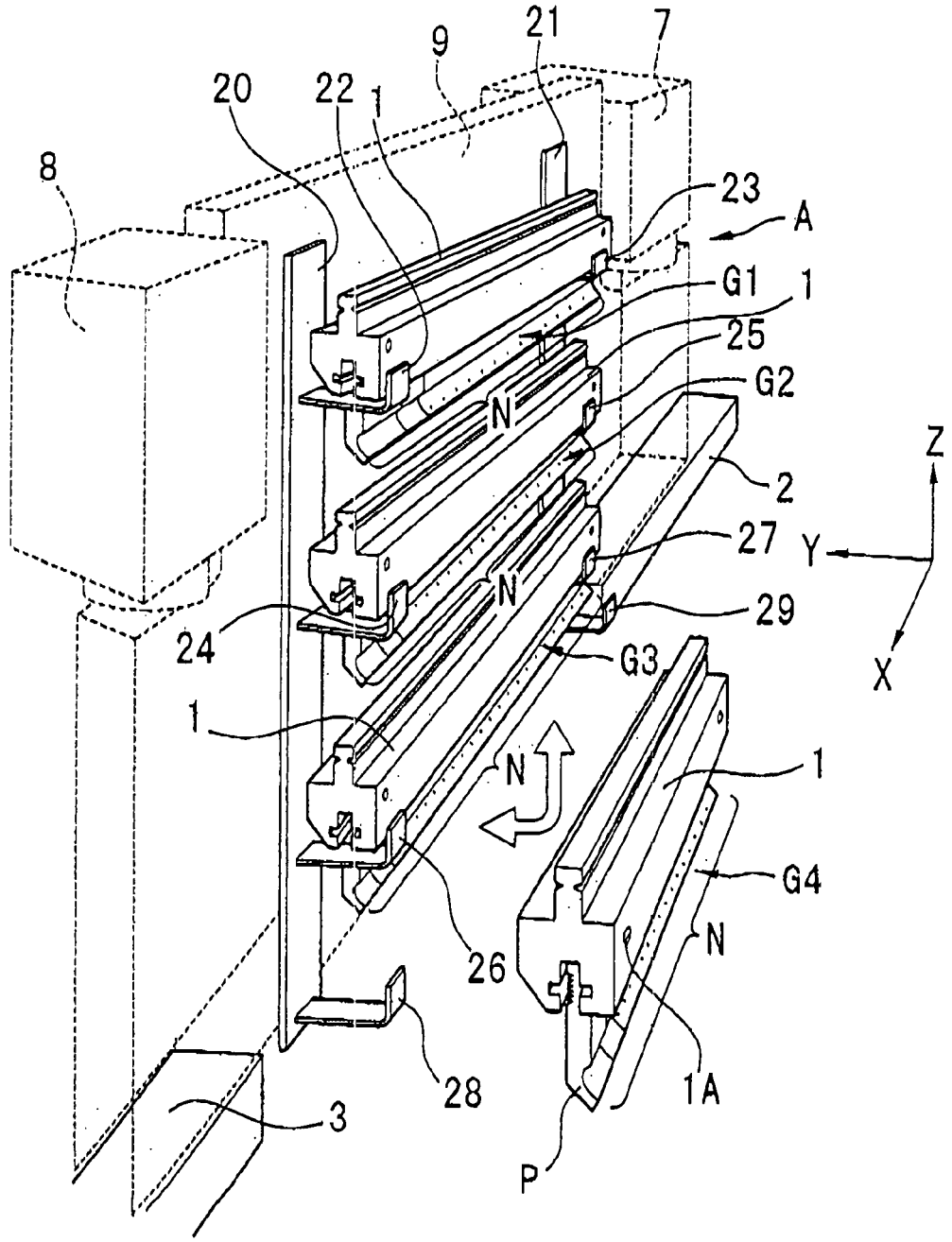
FIG. 3 is a perspective view of tool housing device A constituting the invention.

For example, the tool housing means Aon the punches P side, illustrated in FIG. 3, is provided on the rear face of the upper table 9.

In FIG. 3, housing frames 20, 21 which extend up and down (Z-axial direction) are provided on the rear face of the upper table 9, and multi-tire first racks 22, 23, second racks 24, 25, third racks 26, 27, and fourth racks 28, 29 are attached to the housing frames 20, 21 in the descending order.

Such multistage racks house the plurality of tool groups G1 to G4 each comprising the certain number N of the tools with the same shape and the same length as described above, for each tool holder.

For example, the individual first racks 22, 23 house the 250 straight-sword type (FIG. 19(A)) punches P each having a length of 5 mm, and the individual second racks 24, 25 house the 250 goose-neck type punches P each having a length of 5 mm, for each tool holder 1.

Support frames 38 extending up and down are provide outside the housing frames 20, 21 (FIG. 5) constituting the tool housing device A (FIG. 4), and the tool exchanging device B is attached to the support frames 38.

In general, the tool exchanging device B, B' (FIG. 1) exchange desired tool groups for each tool holder between the tool housing device A, A' and the upper and lower tables 9, 10 (corresponding to FIG. 6(B) to FIG. 6(E)).

In this case, when the plurality of process stations ST1, ST2, ST3, and ST4 which contain the tool groups comprising tools $P_G$, $D_G$, $P_H$, and $D_H$, with different shapes (FIG. 17(B)) are to be formed, the tool exchanging device B, B' return only tool holders $\mathbf{1}_G$, $\mathbf{4}_G$ broken line in FIG. 17(A)), which are empty after the goose-neck type tool holders $P_G$, $D_G$, e.g. are positioned at predetermined positions (FIG. 17(B)), to the tool housing device A, A', and instead of those, newly bring the tool groups which comprises the straight-sword type tools $P_H$, $D_H$ for each tool holder $\mathbf{1}_H$ or $\mathbf{4}_H$ (FIG. 17(B)).

Figure 4:
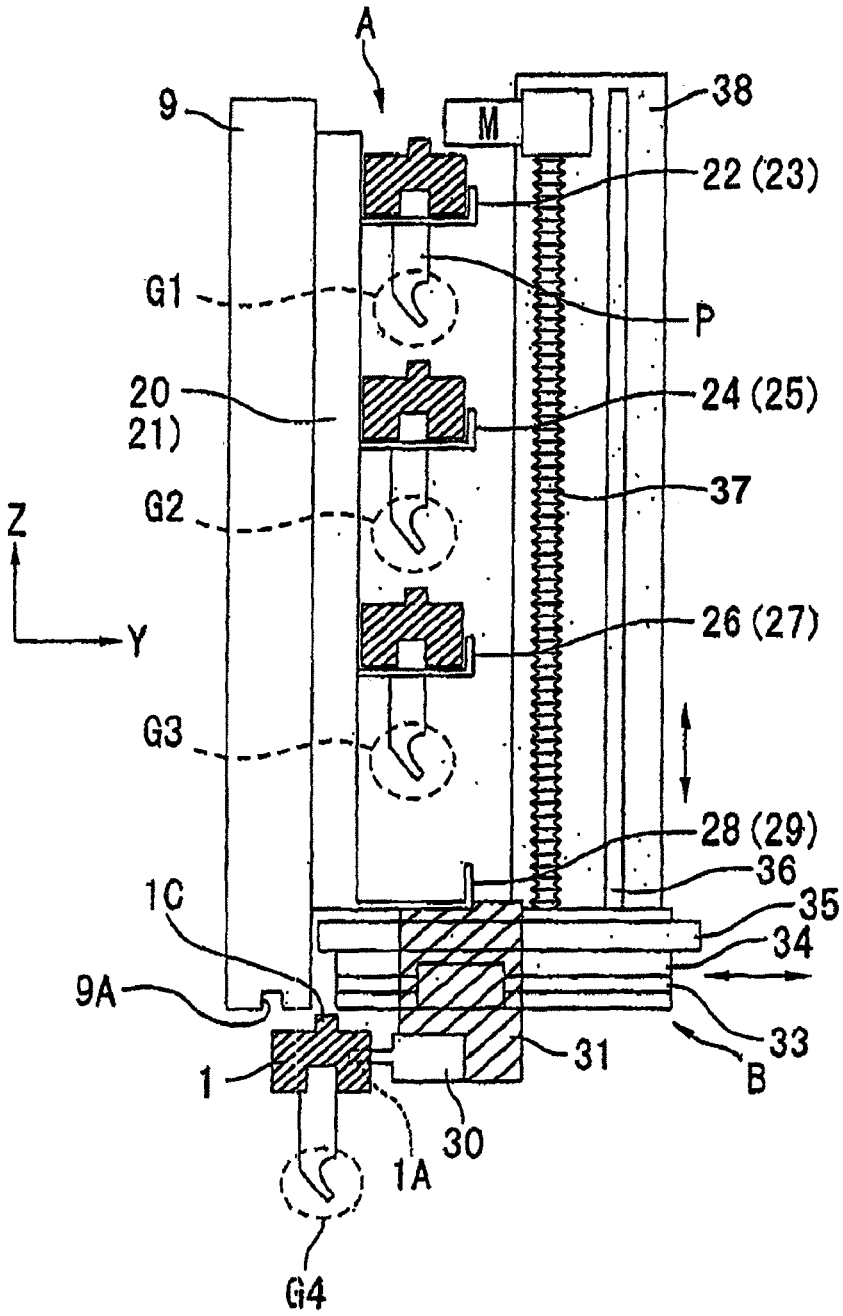
FIG. 4 is a side view of tool exchanging device B constituting the invention.
Figure 5:
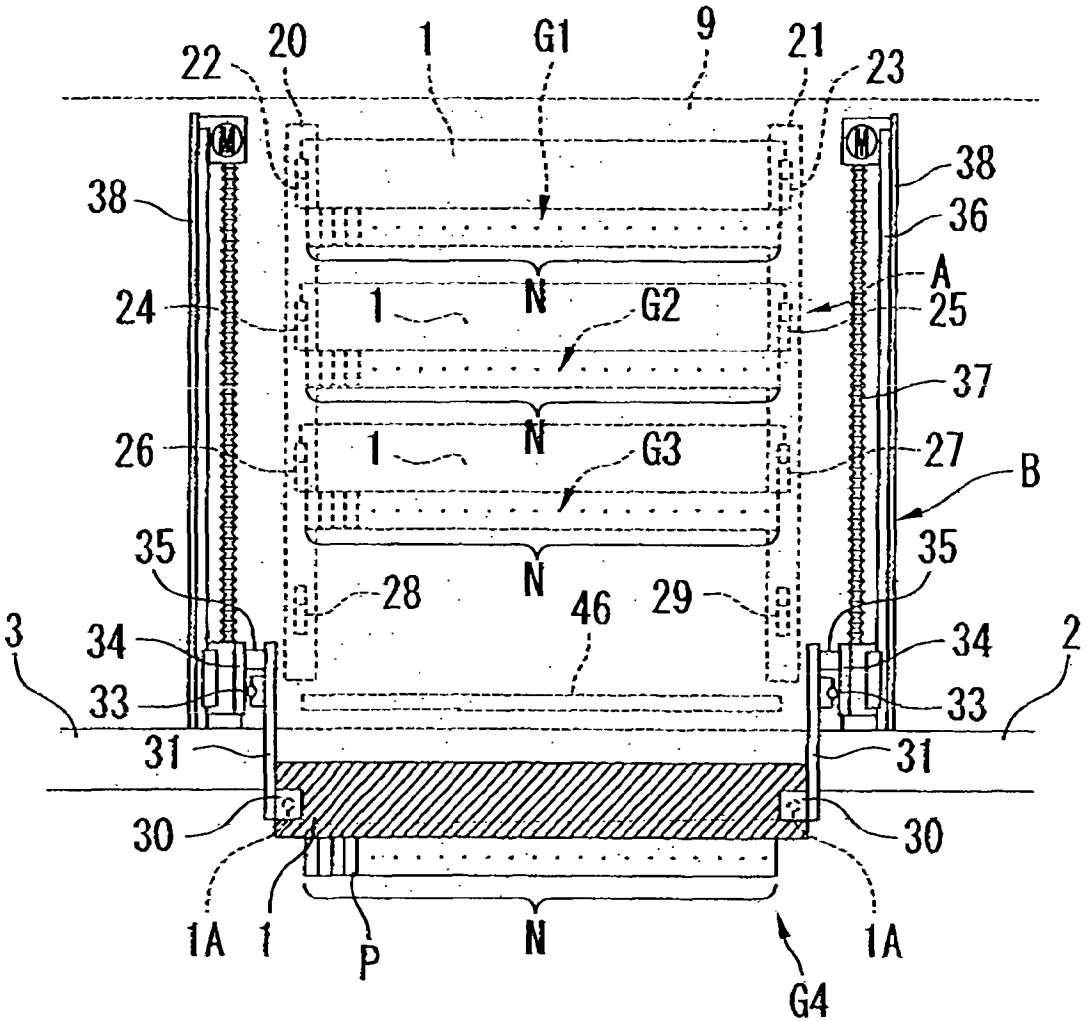
FIG. 5 is a front view of the case of FIG. 4.

The tool exchanging device B (FIG. 4) at the punch P side has holder hold members 30, and the holder hold members 30 can be engaged with engagement holes 1A formed in both sides of the rear the tool holder 1 (FIG. 5).

The holder hold members 30 are attached to the bottom portion of a back-and-forth slider 31, and the back-and-forth slider 31 is slidably connected to a Y-axis guide 33 laid in an up-and-down slider 34, and is moved back and forth (Y-axial direction) by a rod-less cylinder 35 placed in the up-and-down slider 34.

The up-and-down slider 34 is slidably connected to a Z-axis guide 36 laid in a support frame 38, and is moved up and down (Z-axial direction) by threadably engaging with a ball screw 37 which is rotated by a motor M.

According to this structure, the tool exchanging device B engages the holder hold members 30 with the engagement holes 1A of the tool holder 1 of the desired tool group G4 comprising the predetermined shaped tools housed in the tool housing device A, selects the desired tool group G4, lowers the holder hold members 30 and moves them frontward, thereby bringing them in closer relationships with the bottom center of the upper table 9, and transferring the selected desired tool group G4 to the upper table 9 for each tool holder 1 (FIG. 4, and FIG. 5).

Figure 6:
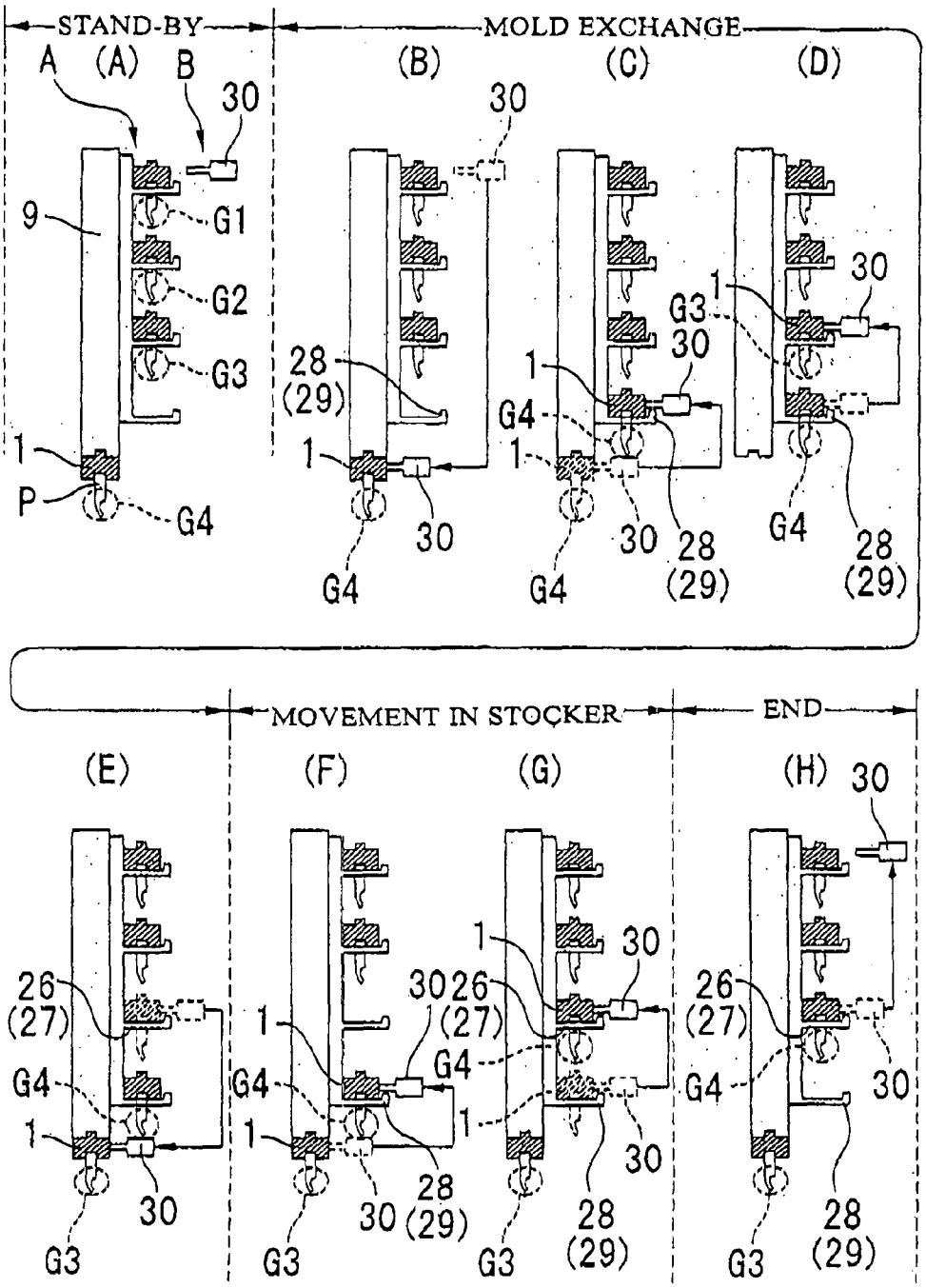
FIG. 6 is an explanatory diagram of an operation in the case of FIG. 4.

The detailed operation of the tool exchanging device B in this case is as shown in FIG. 6.

That is, in FIG. 6(A), the stand-by holder hold members 30 are moved downwardly (FIG. 6(B)), and hold the tool holder 1 of the used tool group G4 at the bottom end of the upper table 9, back away and move upwardly, and house it in the lowest fourth racks 28, 29 of the tool housing means A (FIG. 6(C)), thereby returning the used tool group G4 for each tool holder 1.

The holder hold members 30 are detached from the tool holder returned to the fourth racks 28, 29 (FIG. 6(D)) and moved upwardly, the tool holder 1 of the tool group G3 housed in the third racks 26, 27 above the fourth racks is held, moved downwardly as it is (FIG. 6(E)), and moved frontward, thereby transferring it to the bottom end of the upper table 9, and fixing the tool holder 1 held by the holder hold member 30 with the tool group G3 to the upper table 9 through a holder clamp member 46 (FIG. 7(A)) to be discussed later.

Accordingly, the holder hold members 30 of the tool exchanging device B have transferred the tool group G3 to be used (FIG. 6(E)) from the tool housing means A to the upper table 9 for each tool holder 1.

The holder hold members 30 detached from the tool holder 1 fixed to the upper table 9 (FIG. 6(F)) are moved backward and upward, and hold the tool holder 1 of the used tool group G4 returned to the lowest fourth racks 28, 29 of the tool housing device A in FIG. 6(C) (FIG. 6(F)).

The holder hold members 30 holding the tool holder 1 of the used tool group G4 (FIG. 6(G)) are moved upward further, and house the used tool group G4 in the third racks 26, 27 above the fourth racks for each tool holder 1.

Accordingly, with the lowest fourth racks 28, 29 of the tool housing device A being empty and always kept in conditions as shown in FIG. 6(B), the used tool group is once housed in the lowest fourth racks 28, 29 for each tool holder 1 (FIG. 6(C)).

After the lowest fourth racks 28, 29 are emptied (FIG. 6(G)), the holder hold members 30 are detached from the tool holder 1 of the used tool group G4 housed in the third racks 26, 27 above the fourth racks (FIG. 6(H)), and the holder hold members 30 are moved upward and returned to the original stand-by position, and then all operations are finished.

Figure 7:
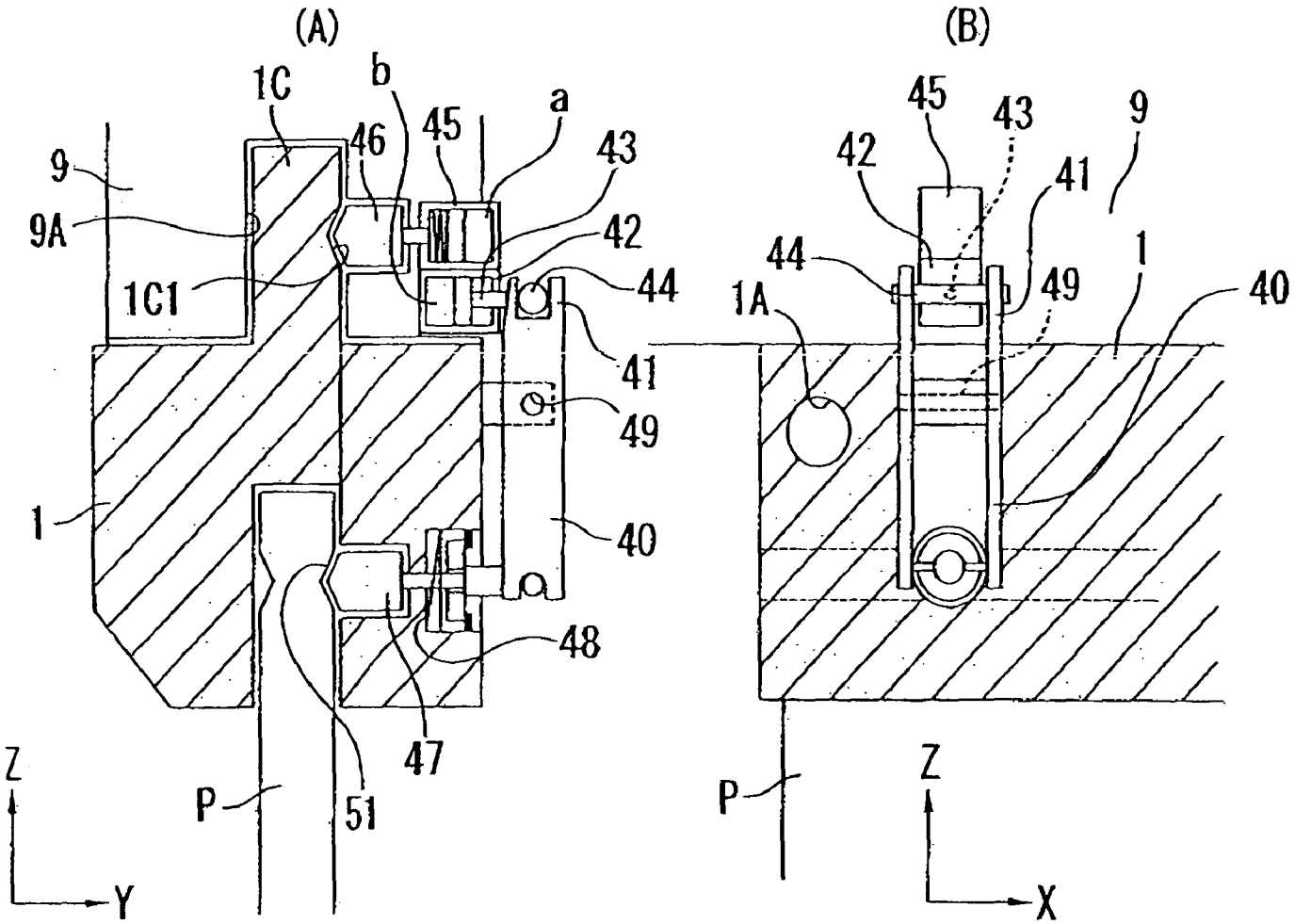
FIG. 7 is a diagram illustrating a coupling relationship between an upper table 9 and a tool holder 1, and a coupling relationship between the tool holder 1 and a tool, all constituting the invention.
Figure 8:
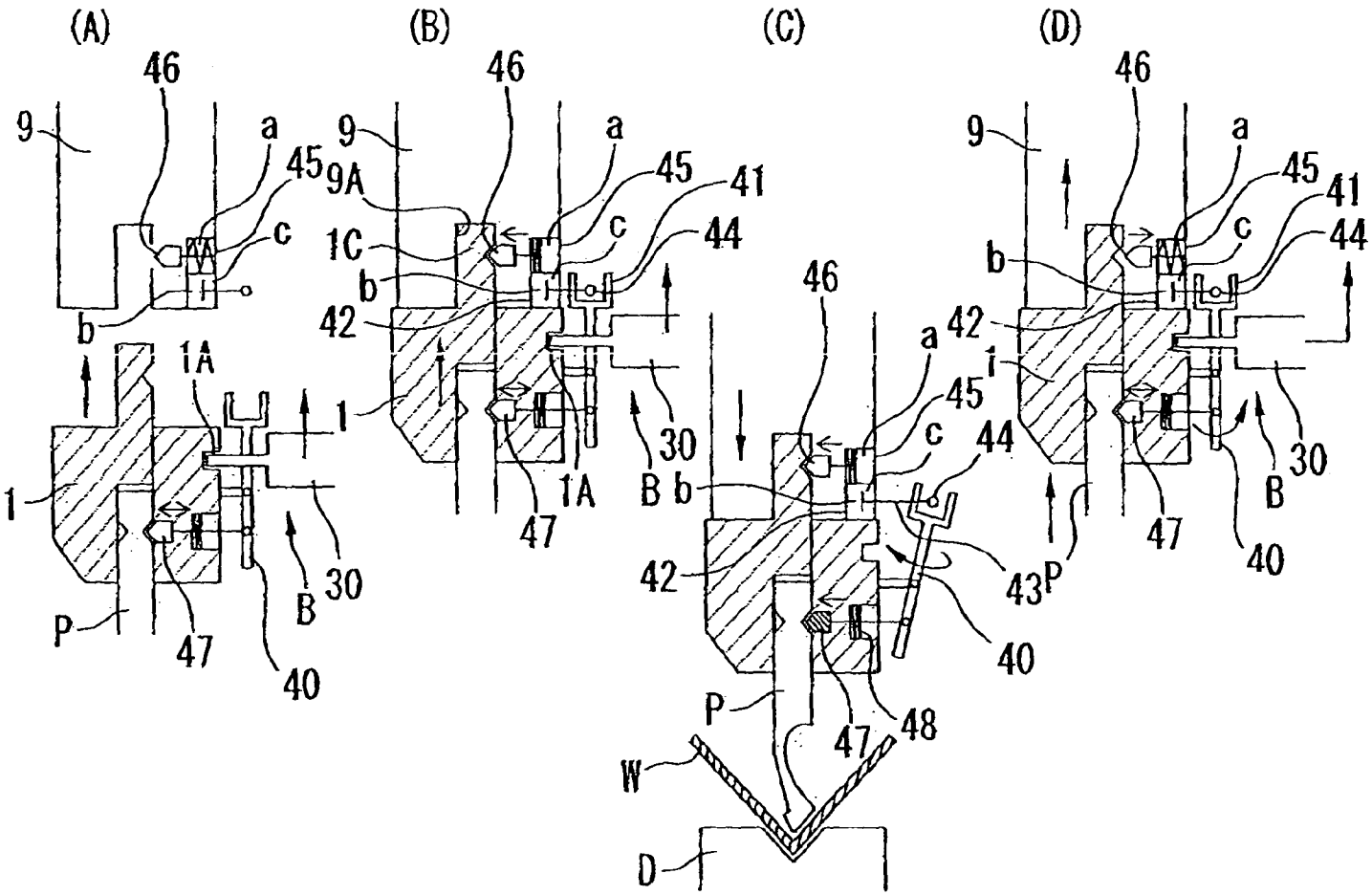
FIG. 8 is an explanatory diagram of an operation in the case of FIG. 7.

By the tool exchanging device B having the holder hold members 30 which perform such operations, the tool holder 1 of the tool group transferred from the tool housing device A to the upper table 9 is fixed to the bottom end of the upper table 9 through the holder clamp member 46 illustrated in FIG. 7 as discussed above.

That is, as illustrated in FIG. 7(A), the holder clamp member 46 is embedded in the upper table 9, and the holder clamp member 46 is actuated by a cylinder 45, and is engaged with a V groove 1C1 of a tool holder protrusion 1C inserted in an angular groove 9A of the upper table 9 when protruding, thereby fixing the tool holder 1 to the upper table 9 (FIG. 8(A)).

The hinge members 40 each turnable around a turning shaft 49 are attached to the rear portion of the tool holder 1, and the hinge member 40 has a fork-like portion 41 on its upper part, and the bottom part thereof is connected to a punch clamp member 47.

The hinge members 40 are turned by cylinders 42 placed below the cylinders 45 of the upper table 9.

According to this structure, in a case where the tool holder 1 is just before attached to the upper table 9, that is, in a case where the holder hold members 80 of the above-described tool exchanging device B transfer the tool holder 1 to the bottom end of the upper table 9 (FIG. 8(A)), room a, room b and room c of the cylinder 45 are all in conditions where no oil is supplied, and are in off conditions (FIG. 9, ①).

At this time, tools in the tool holder 1, for example, the punches P (FIG. 8(A)) are caught by punch clamp members 47 connected to the hinge members 40 so as not to fall, and the punch clamp members 47 are in free conditions by operations of springs 48 with cushioning functions.

In this condition, in a case where the holder hold members 30 of the tool exchanging device B move upward (FIG. 8(B)), and the protrusion 1C of the tool holder 1 is inserted into the angular groove 9A, the fork-like portion 41 of the hinge member 40 of the tool holder 1 is engaged with a lateral rod 44 of a piston rod 43 of the cylinder 42 placed at the upper table 9 side.

At this time, the room a of the cylinder 45 at the upper table 9 side is supplied with an oil, and becomes an on condition (FIG. 9, ②), the holder clamp member 46 (FIG. 8(B)) protrudes, and the tool holder 1 held by the holder hold members 30 of the tool exchanging means B is fixed to the upper table 9.

Both of the room b and room c of the cylinder 45 are not supplied with an oil and are in off conditions as same as before (FIG. 9, ②), and accordingly, the punches P are caught by the punch clamp members 47 and supported by the mold holder 1, and thus the tool group is movable and slidable, and is in a condition for ensuring positioning (FIG. 16(A)).

In this condition, the desired tool groups G3, G3' are split into a plurality of tool groups g1 to g4, g1' to g4' by the separators 60 which constitute the process-station formation device C to be discussed later, and are positioned at predetermined positions to form a process station (FIG. 16(D)), a room b of a cylinder 42 (FIG. 8(C)) is supplied with an oil, and becomes in an on condition (FIG. 9, ③), the piston rod 43 (FIG. 8(C)) protrudes, the hinge member 40 engaged with the lateral rod 44 rotates clockwise as illustrated in the figure, and the tool clamp member 47 overcomes force of the spring 48, and presses the punch P.

Therefore, because the punches P are clamped by the tool holder 1, when the upper table 9 is moved downward, bending is performed on a workpiece W by the dies D and the punches together.

After the bending, the upper table 9 (FIG. 8(D)) is moved upward and returned to the original position, and, with the tool holder 1 being held by the holder hold members 30 of the tool exchanging device B, as the room a of the cylinder 45 and the room b of the cylinder 42 are brought into the off condition (FIG. 9, ④)) and the room c of the cylinder 42 is brought into the off condition, the punches P are un-clamped by force of the springs 48 (FIG. 7).

Accordingly, the tool holder 1 is released from the upper table 9, the hinge member 40 turns counterclockwise as illustrated in the figure, the punch clamp members 47 become back in the free conditions, and the punches P are supported by the punch clamp members 47 so as not to fall from the tool holder 1.

Therefore, the tool group which finishes the bending is held by the holder hold members 30 of the tool exchanging device B for each tool holder 1, and is returned to the lowest fourth racks 28, 29 of the above-described tool housing means A (condition shown by FIG. 6(C)).

Figure 10:
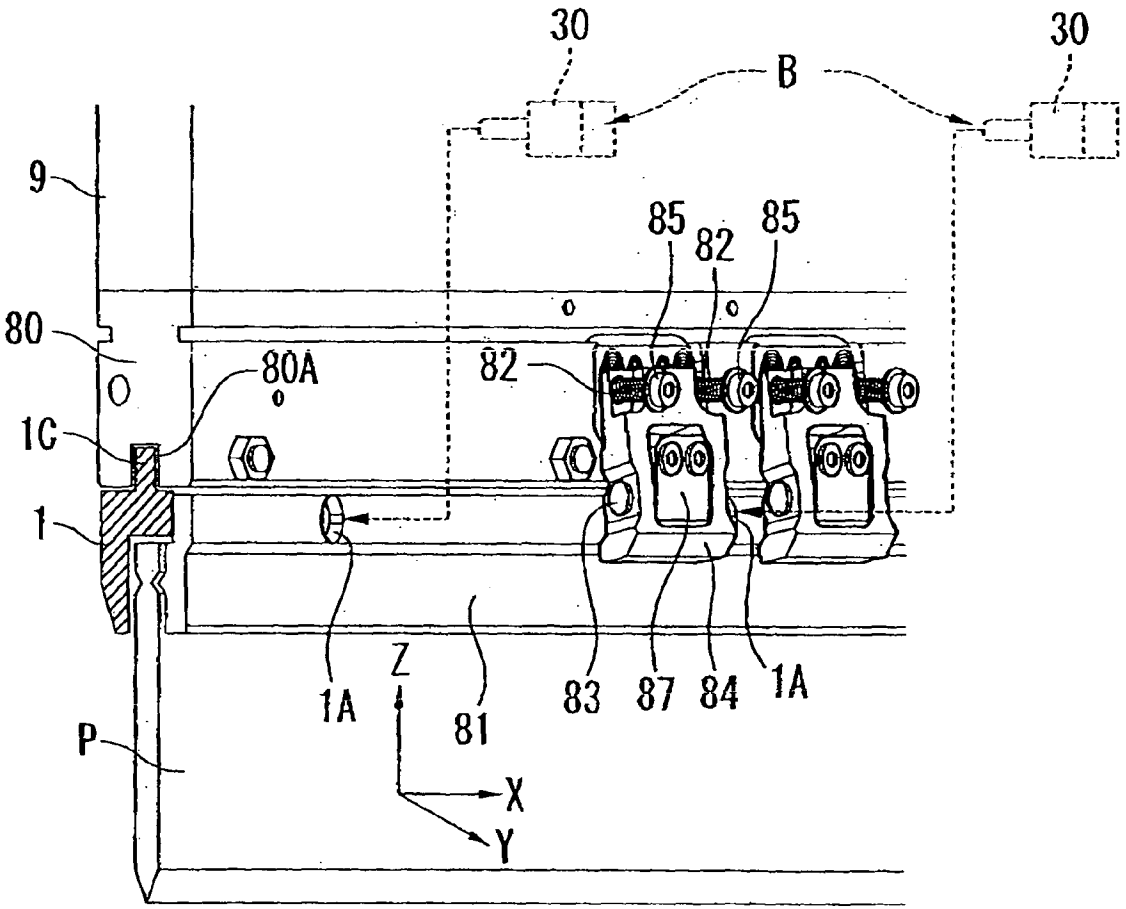
FIG. 10 is a diagram illustrating another example of FIG. 7.

FIG. 10 illustrates another example of FIG. 7, and the different point from FIG. 7 is that turning members 84 (in FIG. 7, the hinge member 40 and the punch clamp member 47) which fixes the punch P to the tool holder 1 is provided at the upper table 9 side.

Figure 12:
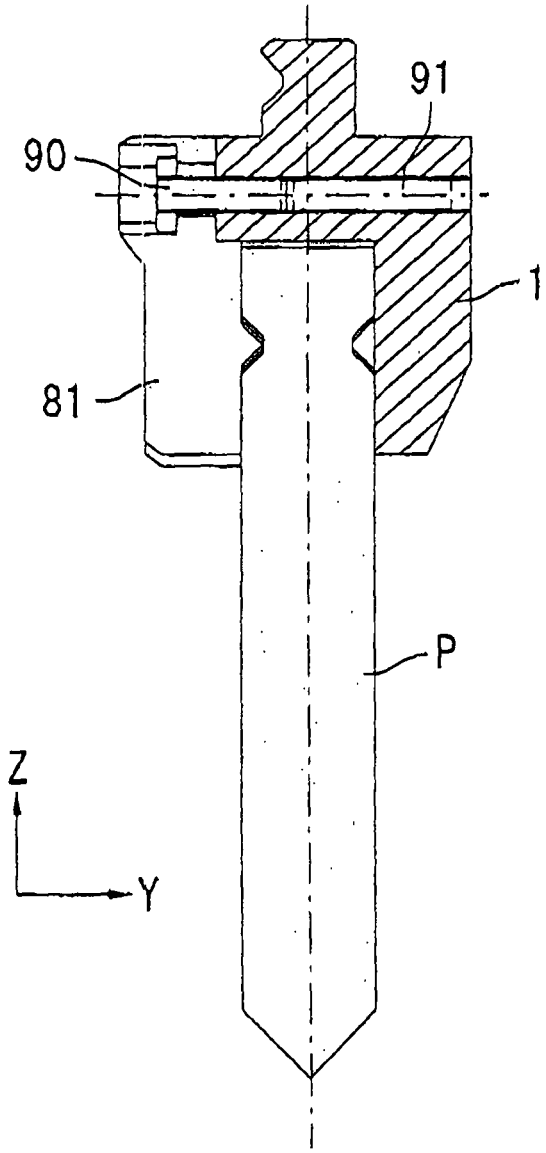
FIG. 12 is a diagram illustrating a tool holder in FIG. 10.

That is, in the case of FIG. 10, the tool holder 1 (FIG. 12) has a tightening plate 81, and holds the punch P through the tightening plate 81, and an appropriate clearance is set by adjustment bolts 90 and locking screws 91, so that falling of the punch P in a free condition is prevented.

Such a tool holder 1 (FIG. 10) is provided with the engagement holes 1A, and as the holder hold members 30 of the tool exchanging means B are engaged with the engagement holes 1A, the tool holder 1 is transferred to the upper table from the tool housing device A (FIGS. 3 to 6), and the protrusion 1C (FIG. 10) is inserted into the angular groove 80A of an attachment section 80.

Figure 11:
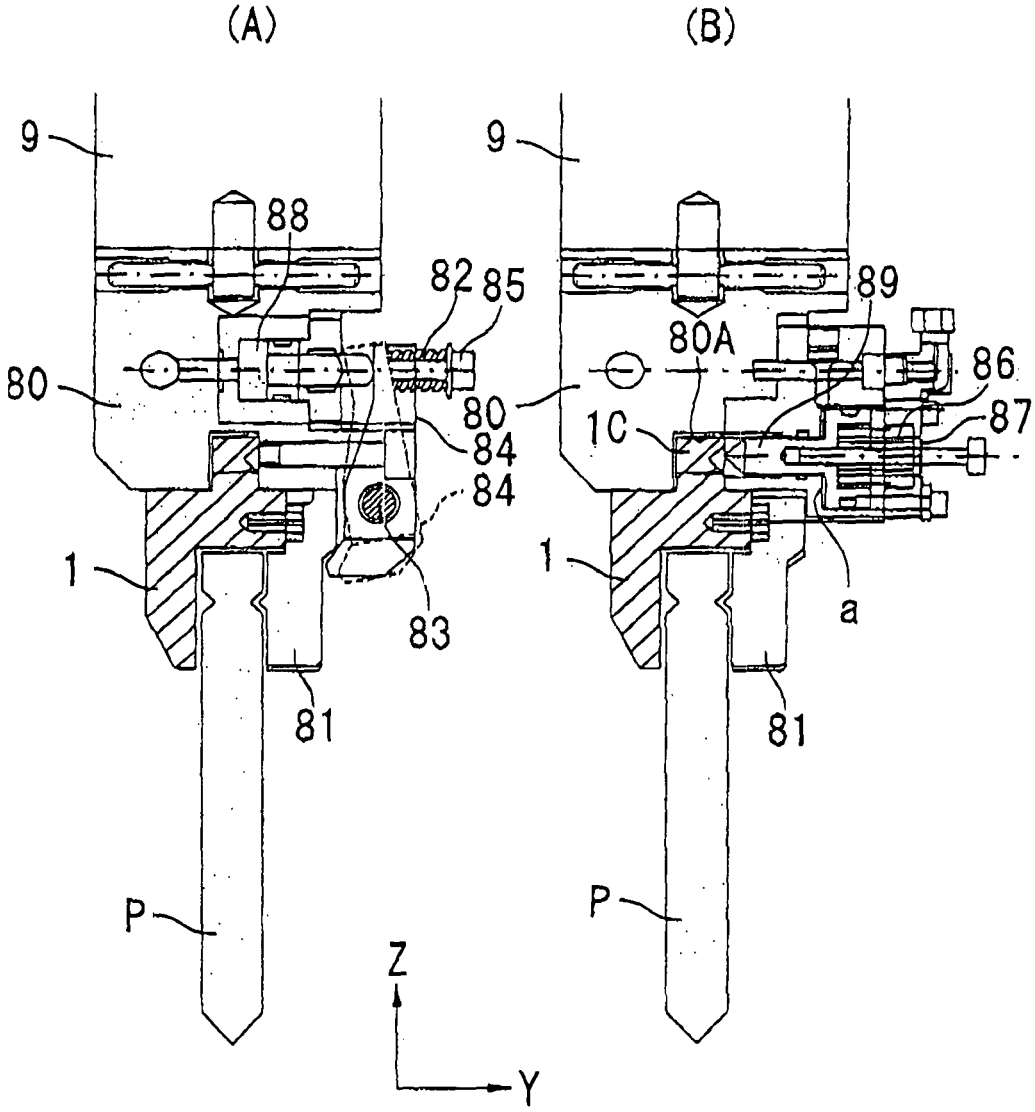
FIG. 11 is a detail drawing of FIG. 10.

In this condition, after a plurality of process stations (FIG. 16(D)) are formed by clamping the tool holder 1 through a holder clamp member 89 pressed by a compression spring 86 in an air cylinder 87 (FIG. 11(B)), and moving the tool group rightward and leftward (X-axial direction) within the tool holder 1, and as a hydraulic cylinder 88 (FIG. 11(A)) is actuated to turn the turning members 84 clockwise, the tightening plate 81 is pressed so that the punch P is fixed to the tool holder 1, and the tool holder 1 is firmly fixed to the upper table 9 side by clockwise turning force of the turning member 84.

As described above, the turning members 84 illustrated in FIG. 11(A) have functions of fixing the punch P after the formation of the plurality of process stations (FIG. 16(D)) to the tool holder 1, and firmly fixing the tool holder 1 in a clamped condition by the holder clamp member 89 in FIG. 11(B) to the upper table 9 side.

In FIG. 11(A), individual springs 82 are wounded around individual bolts 85, and press the turning members 84, and the turning members 84 are tilted by turning counterclockwise around turning shafts 83 as shown by a broken line (for example, the case where the tool holder 1 is not transferred to the upper table 9 from the tool housing device A (FIG. 3 to FIG. 6)).

The hydraulic cylinder 88 is provided behind (attachment section 80 side) the turning members 84, and as described above, in a case where the tool holder 1 is not transferred to the upper table 9, the piston rod of the hydraulic cylinder 88 is retracted.

However, as the tool holder 1 is transferred to the upper table 9, and the plurality of process stations are formed by moving the tool group rightward and leftward (X-axial direction) within the tool holder 1 as described above (FIG. 16(D)), the hydraulic cylinder 88 (FIG. 11(A)) is actuated and its piston rod protrudes.

Accordingly, the hydraulic cylinder 88 presses the turning members 84 against restoring force of the springs 82, thereby tuning the turning members 84 clockwise around the turning shafts 83 and bringing it into a vertical condition as shown by a continuous line, and the turning members 84 press the tightening plate 81 to fix the punch P to the mold holder 1. As described above, the tool holder 1 is firmly fixed to the upper table 9 side simultaneously by clockwise turning force of the turning members 84.

In FIG. 11(B), the air cylinder 87 which clamps the tool holder 1 is provided at the attachment section 80 side of the upper table 9, and the air cylinder 87 is provided at a position surrounded by the turning members 84 (FIG. 10).

The compression spring 86 is embedded in the air cylinder 87 (FIG. 11(B)), and as described above, the tool holder 1 is clamped through the holder clamp member 89 pressed by the compression spring 86.

When a room a of the air cylinder 87 is supplied with an air, the holder clamp member 89 is retracted against restoring force of the compression spring 86, and the tool holder 1 becomes in an un-clamped condition, and can returned to the tool housing device A (FIG. 3 to FIG. 6) through the holder hold members 80 of the tool exchanging means B (FIG. 10).

FIGS. 7 to 12 explains the punches P side, but because the dies D side has exactly the same structure, and the explanation thereof will be thus omitted.

Figure 13:
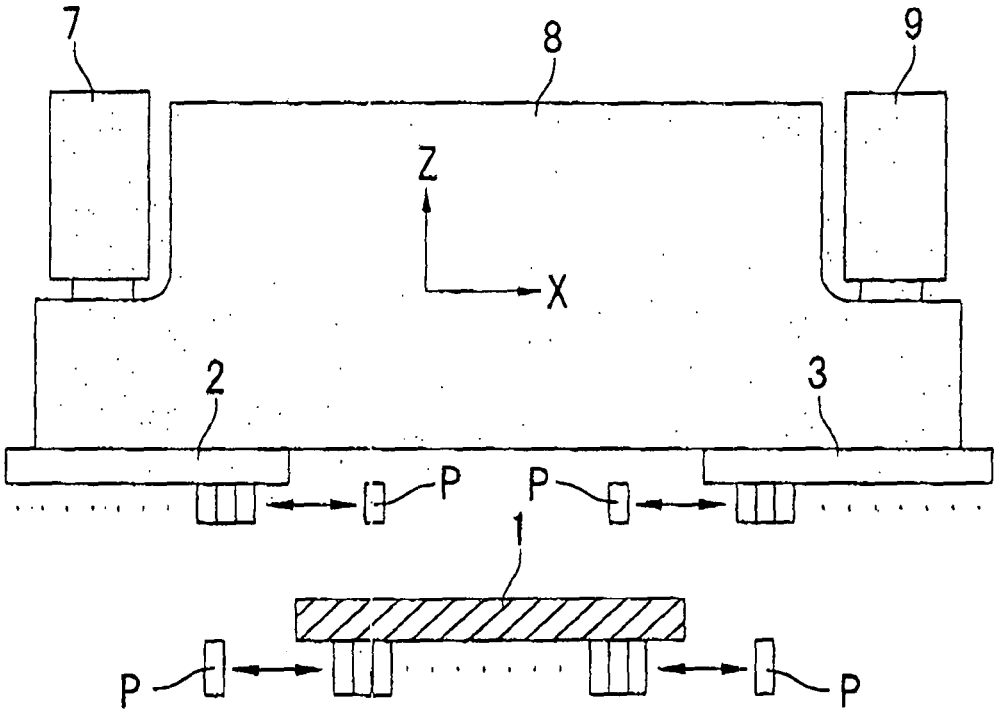
FIG. 13 is an explanatory diagram of simple transversal insertion and transversal pull out operations of a tool with respect to the tool holder according to the invention.

FIG. 13 illustrates manual simple transversal insertion and transversal pull out operations of the punch P with respect to the tool holder 1 (2, 3).

That is, the detailed explanation so far has been given of the operation of automatically exchanging the tool groups for each tool holder 1 between the upper table 9 and the tool housing device A by using the tool exchanging means B (FIG. 1 to FIG. 12).

As illustrated in FIG. 13, however, releasing the attachable/detachable tool holder 1 from the upper table 9 causes creation of a space, and when the space is utilized, it is possible to easily carry out the transversal insertion and transversal pull out manual operations of the punch P with respect to the tool holder 1 (2, 3), and the work of exchanging the tool without the tool exchanging device B (FIG. 1 to FIG. 12), rapidly.

The process-station formation device C (FIG. 1) split the desired mold groups G3, G3' (upper figure in FIG. 2) transferred to the upper and lower tables 9, 10 from the tool housing device A, A' through the tool exchanging device B, B' into the plurality of tool groups g1 to g4, g1' to g4' (lower figure in FIG. 2) comprising the predetermined numbers n1, n2, e.g. of the tools, and positions them at predetermined positions, thereby forming the plurality of process stations ST1, ST2, ST3, ST4.

Figure 14:
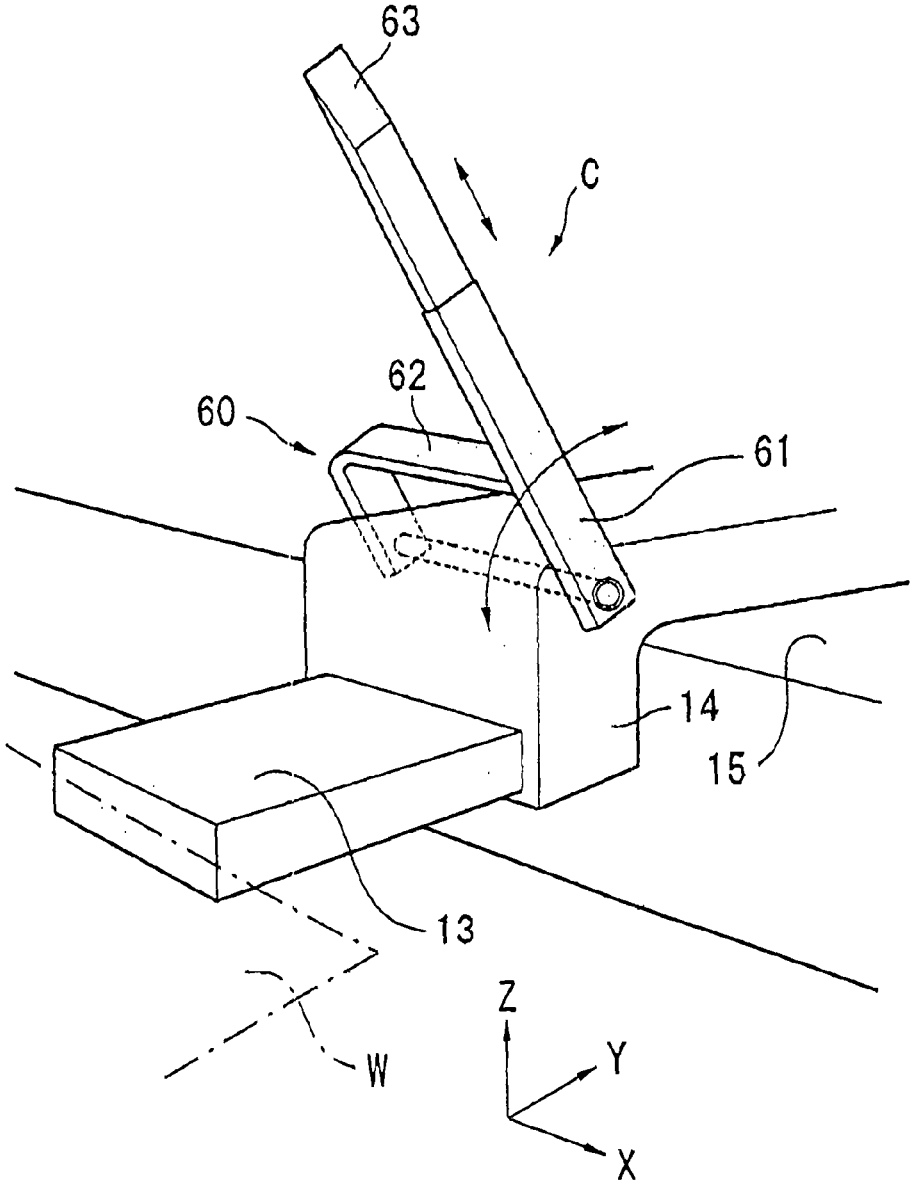
FIG. 14 is a perspective view of process-station formation means C constituting the invention.

The process-station formation device C comprises the separators 60 as illustrated in, for example, FIG. 14.

The separator 60 is movable rightward and leftward (X-axial direction), frontward and backward (Y-axial direction), and upward and downward (Z-axial direction), and for example, as illustrated in the figure, has an arm 61 turnably attached to a main body 14 side of an abutment 13 of a back gauge.

As is well known, the abutment 13 which originally has a function of abutting a workpiece W to position it is attached over a stretch 15 extending rightward and leftward through the main body 14, and is movable rightward and leftward, frontward and backward, and upward and downward, and the separator 60 of the embodiment uses the driving mechanism of the abutment 13.

The arm 61 (FIG. 14) is attached to the main body 14 side of the abutment 18 as described above, turned by a cylinder (not illustrated) or a motor, and provided with a stopper 62 across the abutment 14 entirely.

When a workpiece W is positioned (FIG. 15(A)), if the arm 61 of the separator 60 is turned clockwise, the stopper 62 contacts the top face of the abutment main body 14 and stops at a tilt position, and a leading end section 63 is put in that arm, so that the arm is positioned rearwardly as illustrated in the figure as not to interrupt the positioning of the workpiece W.

Figure 15:
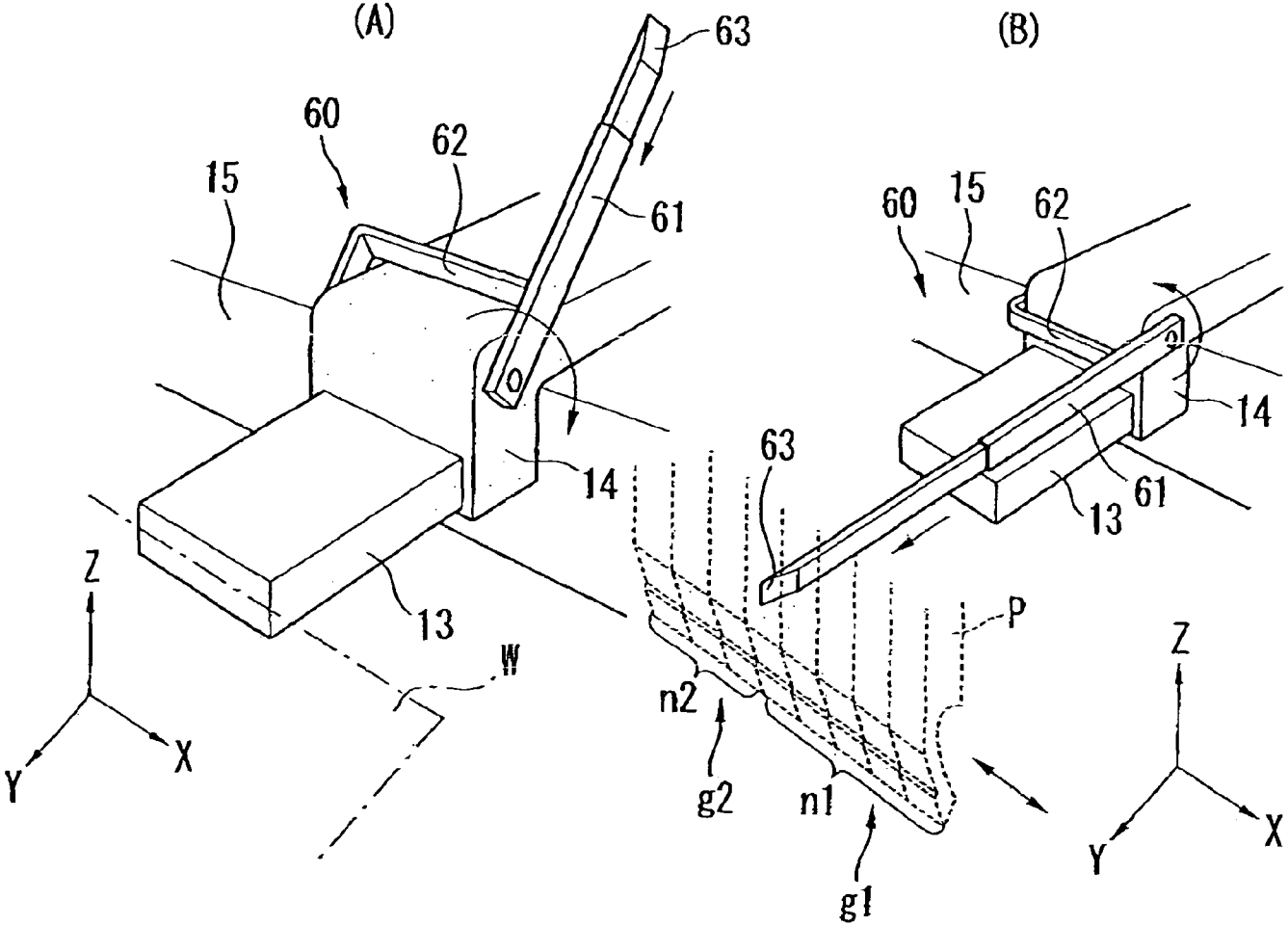
FIG. 15 is an explanatory diagram of an effect of FIG. 14.

When the process stations are formed (FIG. 15 (B)), however, if the arm 61 of the separator 60 is turned counterclockwise, the stopper 62 contacts the front face of the abutment main body 14 and stops at a horizontal position, and the leading end section 63 protrudes, so that the arm extends frontward over the workpiece-abutting face of the abutment 13 to sort the tool group, as illustrated in the figure.

Accordingly, with reference to the number of tools, the tool group g1 comprising, for example, the predetermined number n1 of tools, is pressed by the wedged leading end 63, loosened, moved rightward and leftward (X-axial direction) and stopped at the predetermined position, and the same operation is sequentially performed with respect to the tool group g2 or the like comprising the predetermined number n2 of molds to sort each of the plurality of tool groups g1, g2, e.g. and then they are fixed by the tool clamp members 47 (condition in FIG. 8(C)), thereby forming the plurality of process stations ST1, ST2, ST3, and ST4 (lower figure in FIG. 2).

The explanation has been given of the sorting of the punches P side, but as described above, sorting of the dies D is also carried out by the same separator 60.

Figure 16:
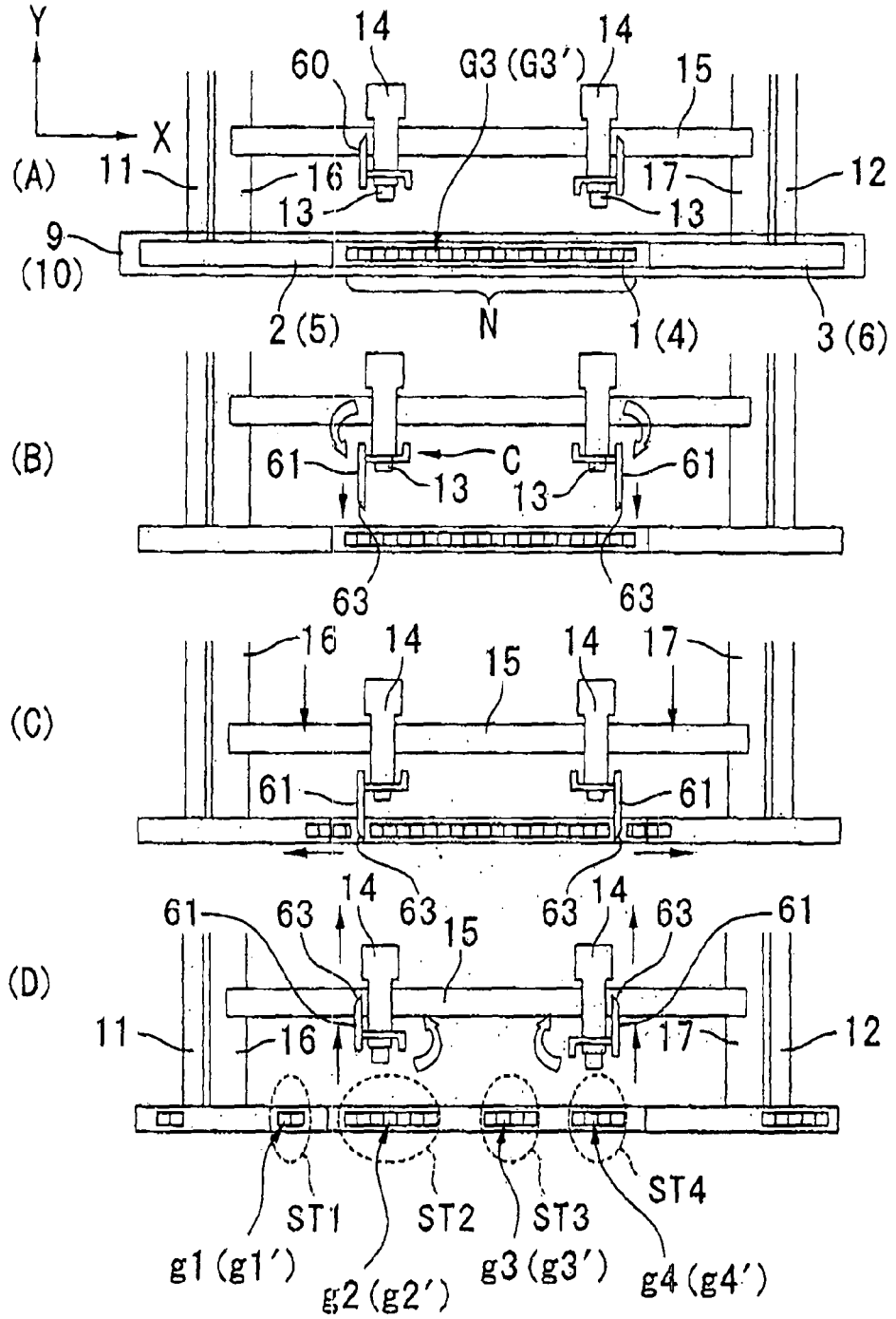
FIG. 16 is an explanatory diagram of an operation of a separator 60 constituting the process-station formation device in FIG. 14.

The detailed operation of the separator 60 in this case is as illustrated in FIG. 16.

That is, the desired tool groups G3, G3' are transferred to the upper and lower tables 9, 10 (FIG. 16(A)) from the tool housing device A, A' through the tool exchanging device B, B' (FIG. 1), along the tool holders 1, 4, the individual separators 60 in the standing-by conditions above the abutment 13 of the back gauge turn the arms 61 frontward (FIG. 16(B)).

In this condition, as the separators 60 are moved frontward further (FIG. 16(C)), the leading end sections 63 of both separators 60 press the tool groups respectively comprising the individual predetermined numbers of tools, loosen and move them rightward and leftward, thereby splitting the original desired tool groups G3, G3' (FIG. 16(A)) into the plurality of the tool groups g1 to g4, g1' to g4' and positioning them, and the plurality of process stations ST1, ST2, ST3, and ST4 are formed (FIG. 16(D)) as described above.

After the process stations are formed, the separators 60 may finish all operations by turning the arms 61 in the opposite direction and putting the leading end sections 63 in the arms 61. The separators 60 are not limited to the embodiment, and the plurality of process stations may be formed from the tool groups using a robot constituted by multiple (six, for example) control axes, and the separators 60 each having a driving mechanism are movable upward and downward, rightward and leftward, and frontward and backward without using the abutments 13 (FIG. 14 to FIG. 16) of the above-described conventional back gauge may be provided on the upper and lower tables 9, 10 of the press brake.

In the above-described example, the explanation has been given of the case where the plurality of process stations are formed regarding the tool groups with the same shape.

Figure 17:
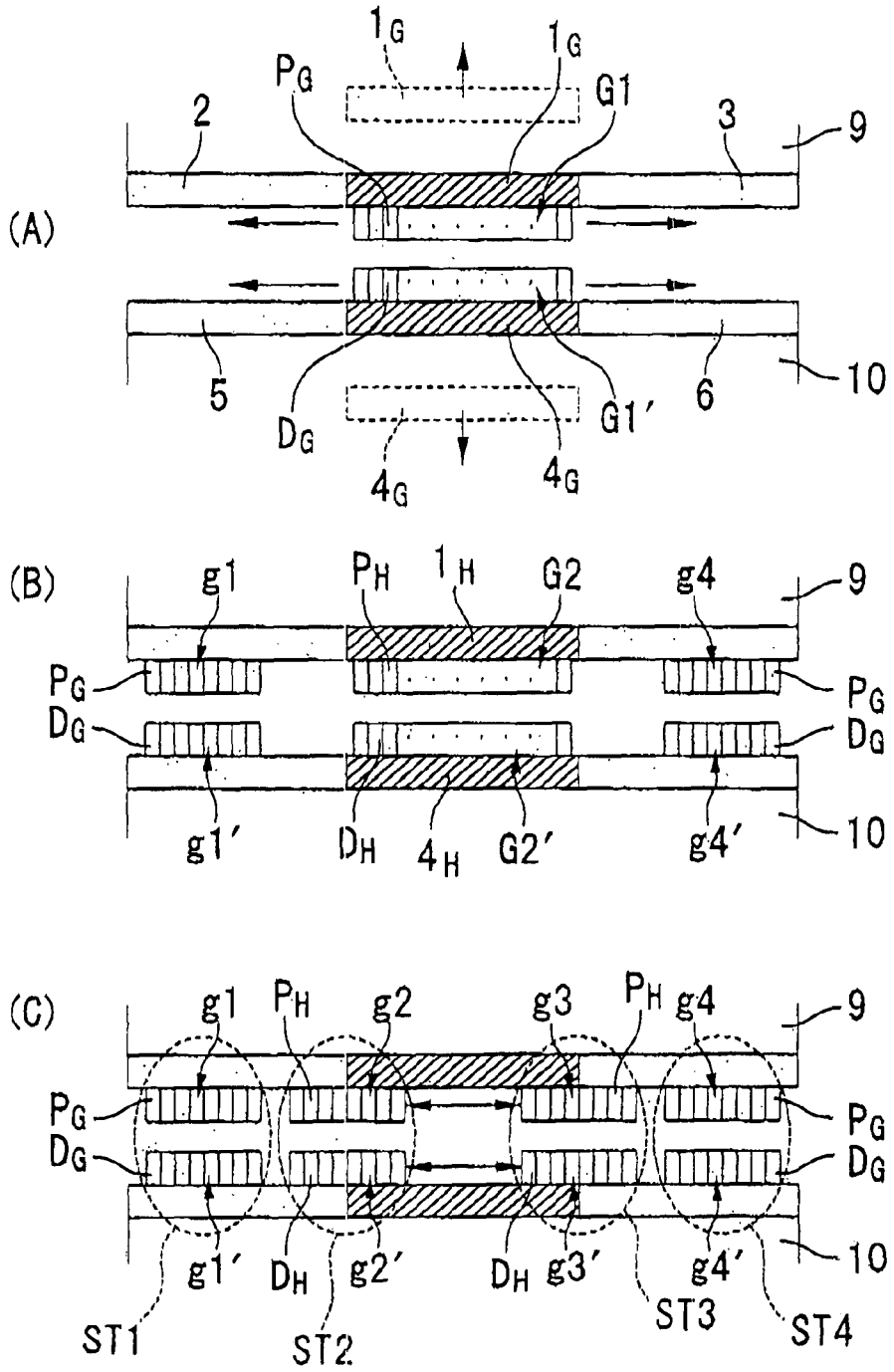
FIG. 17 is a diagram illustrating another example of process-station formation according to the invention.

The invention, however, is not limited to such an embodiment, and can achieve the same operation and effect even if applied to a case where a plurality of process stations include the tool groups with different shapes (FIG. 17).

That is, in FIG. 17, first, the tool groups G1, G1' comprising the goose-neck type tool $P_G$, $D_G$ (FIG. 19(B)) are attached to the upper and lower tables 9, 10 for each tool holder $\mathbf{1}_G$, or $\mathbf{4}_G$ (FIG. 17(A)), and is split into the plurality of tool groups g1, g1', and g4, g4', and the tool groups are moved to the fixed mold holders 2, 3, an 5, 6 at both ends, and positioned, and only the empty tool holders $\mathbf{1}_G$, $\mathbf{4}_G$ are returned to the tool housing device A, A' (FIG. 1).

In this condition, the tool groups G2, G2' comprising the straight-sword type tool $P_H$, $D_H$ (FIG. 19(A)) are attached to the upper and lower tables 9, 10 along with the tool holders $\mathbf{1}_H$, $\mathbf{4}_H$ (FIG. 17(B)), split into the plurality of tool groups g2, g2' and g3, g3' in a similar way as described above, and those mold groups are positioned at the predetermined positions, thereby forming the plurality of process stations ST1, ST2, ST3, and ST4 including both goose-neck and straight-sword type tool groups (FIG. 17(C)).

Figure 18:
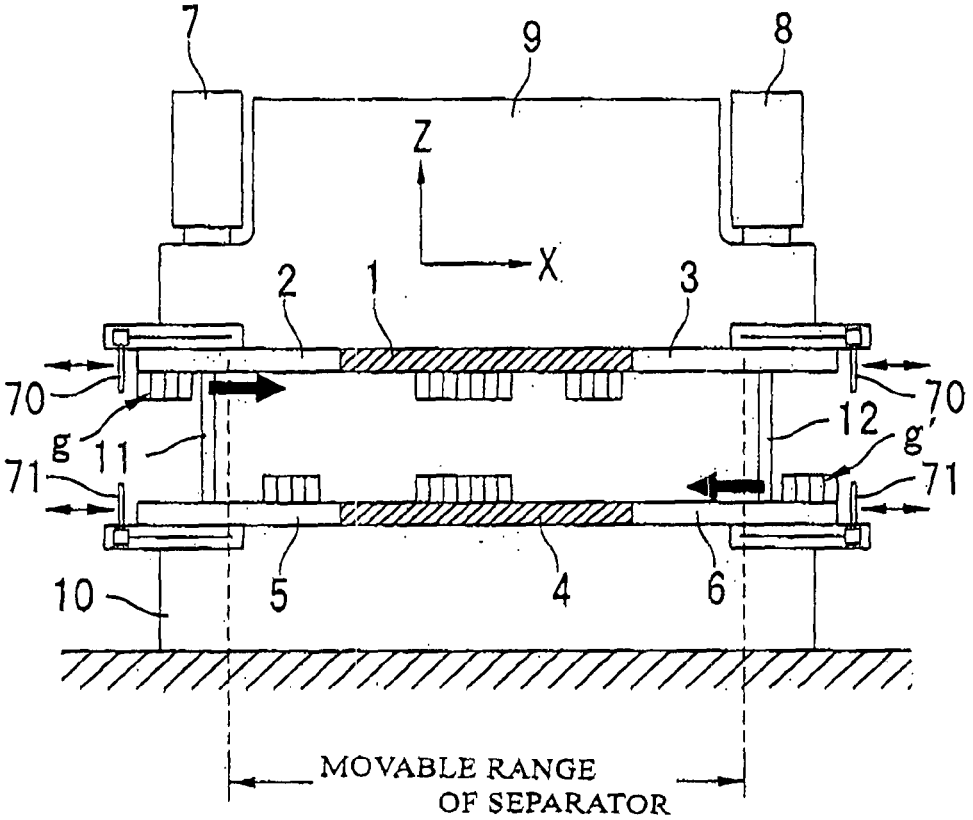
FIG. 18 is a diagram illustrating device for pushing a tool group in the movable range of the separator 60 according to the invention.

FIG. 18 is a diagram illustrating means of pushing the tool groups g, g' within the movable ranges of the separators 60 according to the invention.

That is, the separators 60 which constitute the process-station formation device C (for example, FIG. 14) are attached to the abutments 13 attached over the stretch 16 extending rightward and leftward through the main body 14, and both ends of the stretch 15 (FIG. 16(A)) are supported by supports 16, 17 inside both side plates 11, 12.

Accordingly, as illustrated in FIG. 18, the movable ranges of the separators 60 are limited between both side plates 11, 12, and if there are the tool groups g, g' outside both side plates 11, 12 (both ends of the upper and lower tables 9, 10), it is necessary to push the tool groups g, g' in the movable ranges of the separators 60.

Consequently, pushers 70, 71 as illustrated (for example, driven by cylinders) are provided on both ends of the upper and lower tables 9, 10 to push the mold groups g, g' within the movable range of the separator 60, and the separators 60 (FIG. 14) are so set as to ensure formations of the plurality of process stations, thereby further assuring the operation of the invention.

Figure 20:
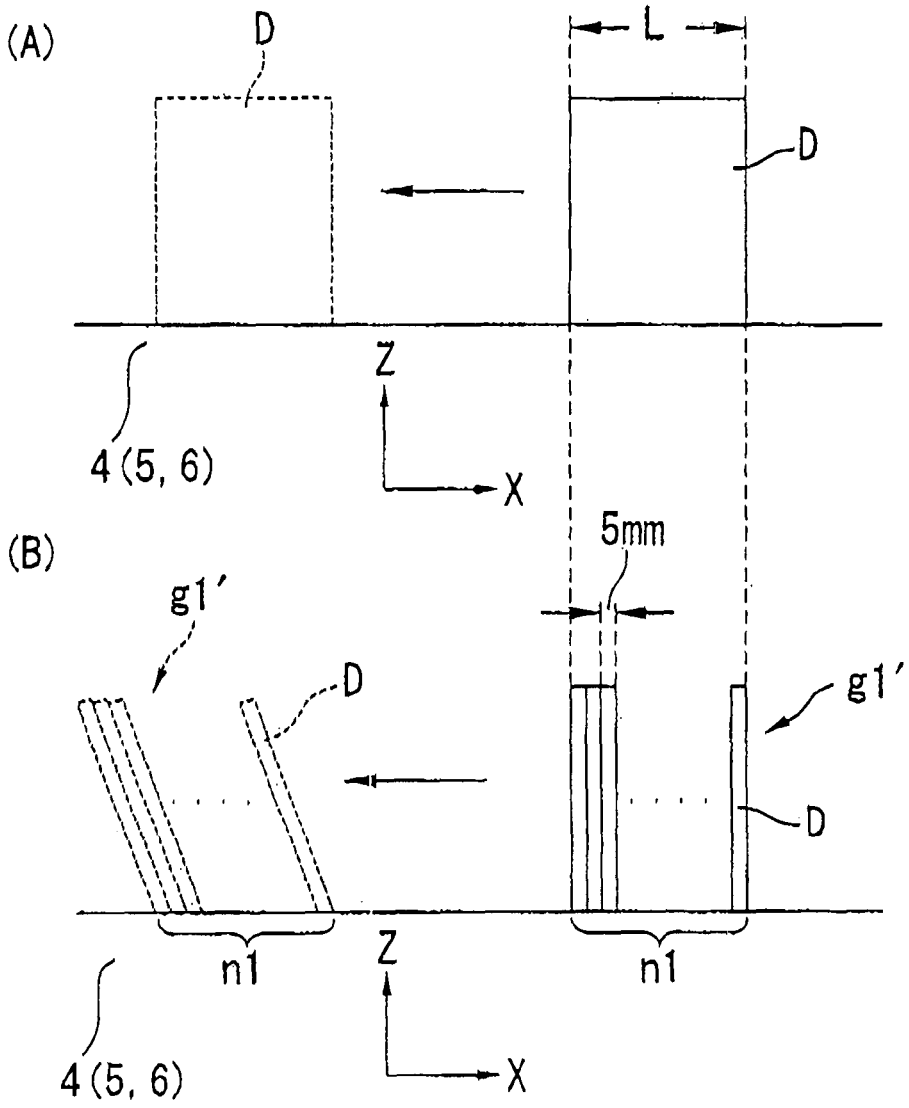
FIG. 20 is a diagram explaining the reason why tools tilt when the process station is formed according to the invention.

FIG. 20 is a diagram illustrating the reason why tools tilt when the process station is formed according to the invention.

In a case where the tool group g1' comprising the predetermined number n1 of the tools are pressed and held together by the separator 60 (FIG. 15(B)), the tools constituting the tool group g1' may tilt.

That is, in FIG. 20(A), for example, if a length L of the die D as one mold is large to some extent, the die D is stable, remains and keeps an upright condition even if it is moved rightward and leftward.

In contrast, as illustrated in FIG. 20(B), suppose that the predetermined number n1 of dies having extremely short lengths, for example, about 5 mm are collected to constitute one tool group g1', and the length of the tool group g1' is L which is the same as the length of one die D illustrated in FIG. 20(A).

Each die D constituting the tool group g1' in FIG. 20(B) is, however, thin and very unstable, and portions where the dies D contact with each other are flat metals, and frictions to be applied to both dies are extremely small.

Accordingly, in a case where the tool group g1' (FIG. 20(B)) is pressed, collected together, and moved rightward and leftward, each die D constituting the tool group g1' tilts frontward as illustrated in the figure (left figure), and becomes unable to keep the upright condition (right figure).

As a result, the process station is not built, and the workpiece W is not bent by the dies and the punches P (FIG. 1), thus lowering the process efficiency.

Consequently, in the invention, the tools, P, D are positioned at the predetermined positions by a tool-tilt prevention apparatus, to be discussed later and illustrated in FIG. 21 and FIG. 22, without tilting, so that the plurality of process stations are built rapidly, and step bending is easily and rapidly coped.

Figure 21:
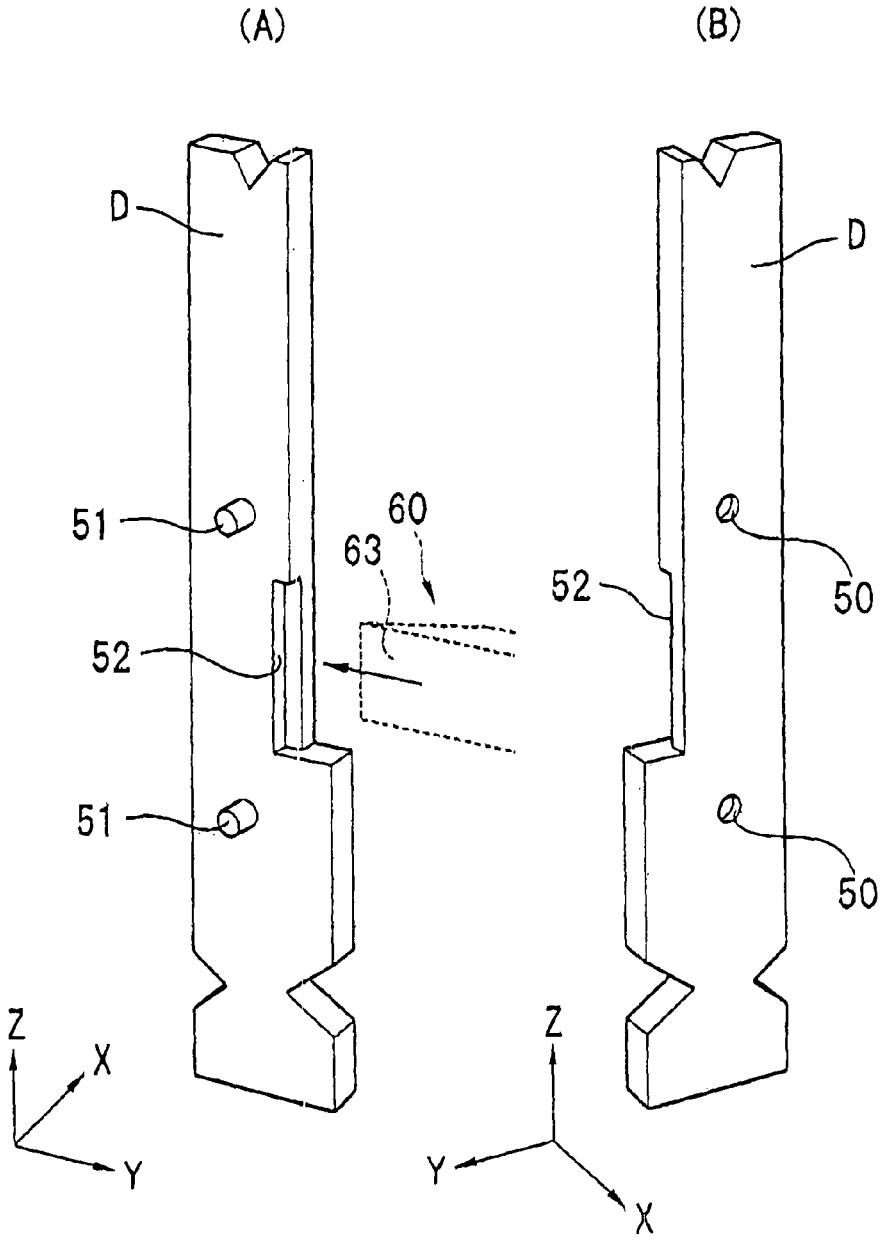
FIG. 21 is an explanatory diagram of recess portions 50 and protrusions 51 constituting a tool-tilt prevention apparatus according to the invention.

That is, FIG. 21 is a perspective view of the tool which is the same die D as viewed from one side thereof and the other side thereof, and, one end (FIG. 21(A)) and the other end (FIG. 21(B)) are respectively provided with recess portions 50, and protrusions 51 which correspond to the recess portions 50.

In the illustrated case, the recess portions 50 and the protrusions 51 are respectively provided doubly, and a separator-insertion groove 52 which faces the separator 60 side and into which the leading end section 63 of the separator 60 is inserted is formed between the pair of recess portions 50 and the pair of protrusions 51.

V grooves are formed below the separator-insertion groove 52 and the both side of the mold in the backward and forward directions (Y-axial direction), and the tool clamp members 47' embedded in the fixed tool holders 5, 6 fixed to the above-described attachable/detachable tool holder 4 (lower figure in FIG. 2)are caught in the V grooves, thus supporting and fixing the tool D.

Figure 22:
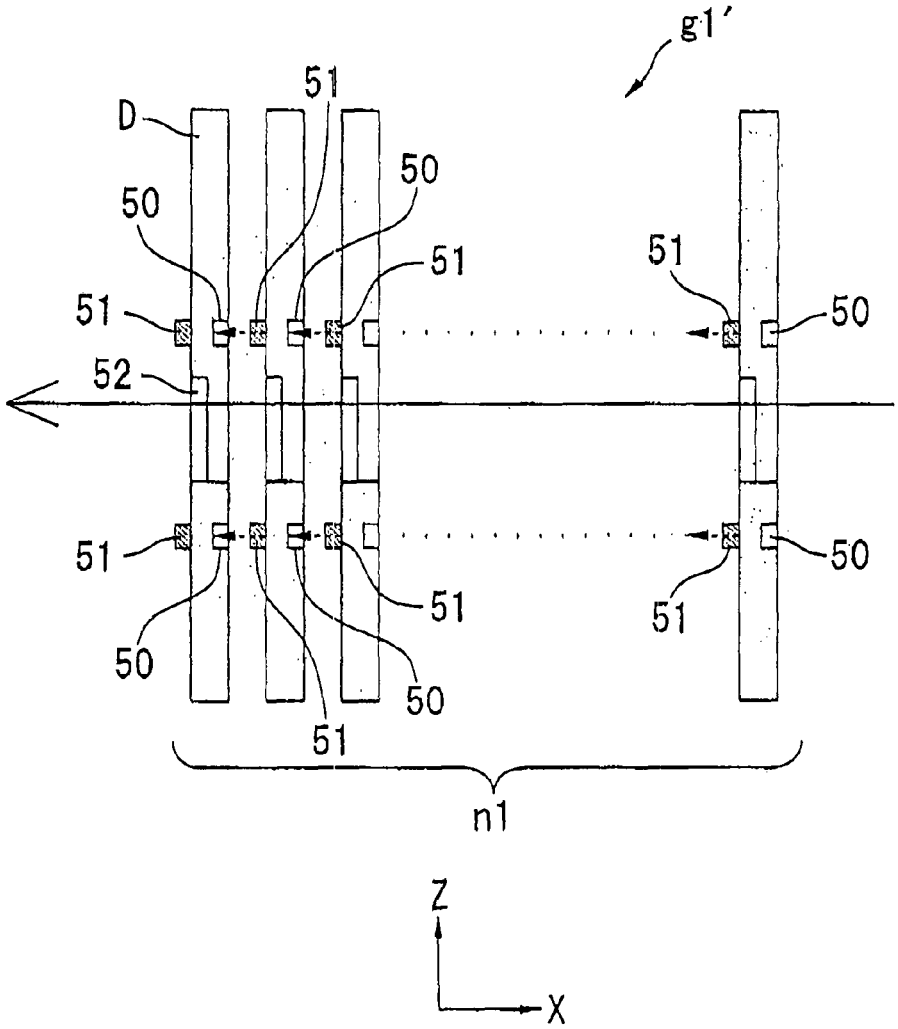
FIG. 22 is an explanatory diagram of the effect of FIG. 21.

According to the structure, for example, as illustrated in FIG. 22, when the tool group g1' is constituted by the predetermined number n1 of tools D connected by the recess portions 50 and the protrusions 51, and the tool D at the right end is pressed leftward, force of this press is transferred leftward sequentially, and thus the predetermined number n1 of tools D contact one another through each recess portion 50 and each protrusion 51.

Therefore, the frictions between the individual pairs of the tools D become large and even if the tool group g1' is moved rightward and leftward (X-axial direction), the individual tools D do not tilt.

Figure 23:
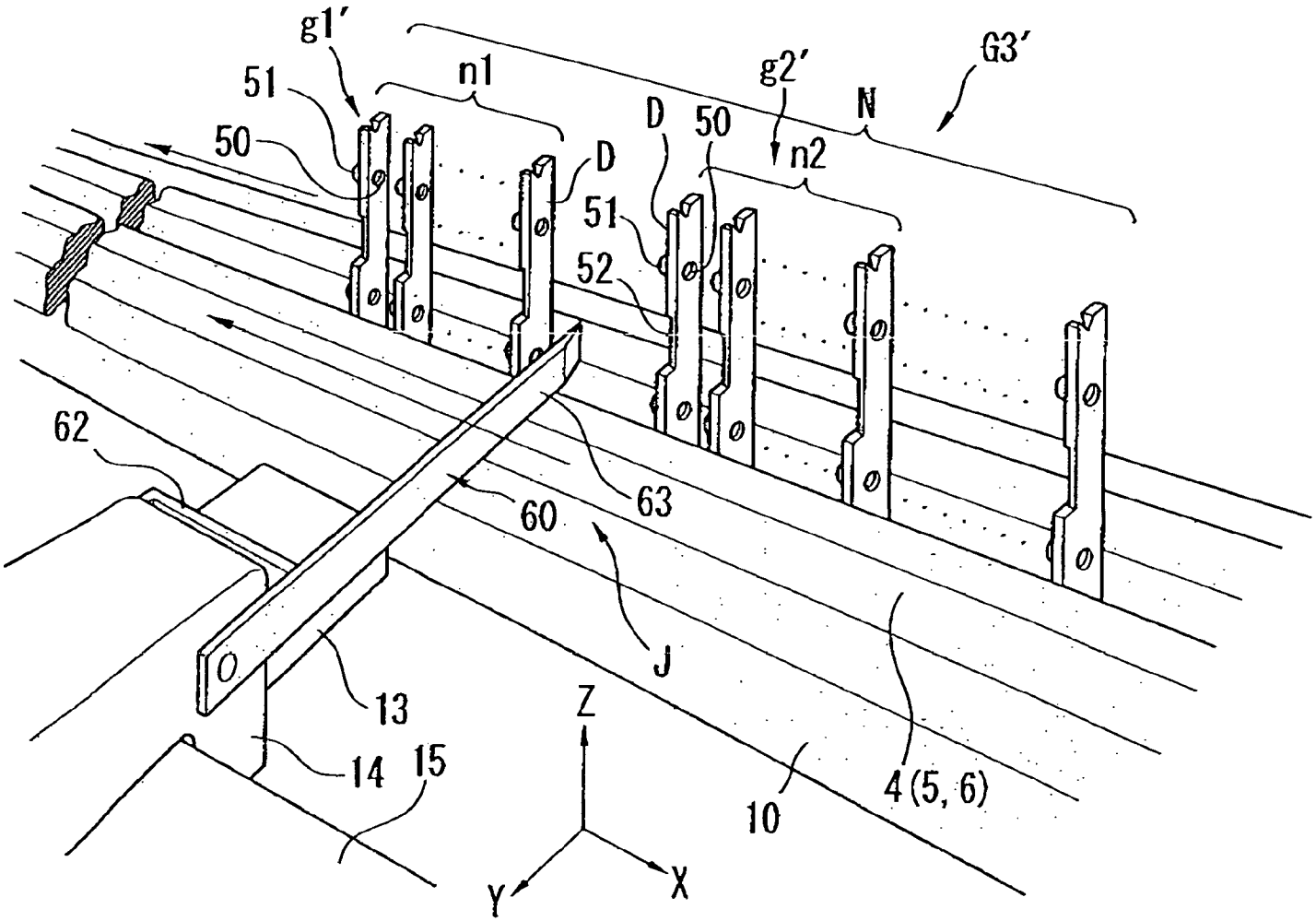
FIG. 23 is an explanatory diagram of the tool-tilt prevention apparatus in FIG. 21 having the recess portions 50 and the protrusions 51.

For example, one tool group G3' that is constituted by a predetermined number N of tools which have the same shape and the same length each provided with the recess portions 50 and the protrusions 51, is attached to the tool holder 4 (5, 6) of the above-described lower table 10 (FIG. 23).

In this condition, the leading end section 63 of the separator 60 is inserted into the separator-insertion groove 62 of the leading tool D of the tool group g2' comprising the predetermined number n2 of tools, and one side of the tool group g1' comprising the predetermined number n1 of tools on the front left, that is, the right side in the case of FIG. 23 is pressed leftward.

Accordingly, the tool group g1' is split from the tool group g2', moves leftward, and is positioned at the predetermined position.

In this case, as described above, the individual pairs of the tools constituting the tool group g1' contact with each other through the recess portions 50 and the protrusions 51 (FIG. 22), and this results in applications of large frictions to their contact portions, and the individual tools do not tilt during the movements, and can keep the upright conditions.

In FIG. 23, one separator 60 comprises one-side pressing and positioning device J, that is, device of positioning the tool group g1' which comprises the predetermined number nil of tools connected by the recess portions 50 and protrusions 51, while pressing one side of that tool group, but like this embodiment, it is not necessary to use the driving mechanism of the abutment 13, and it has an independent driving mechanism.

Figure 24:
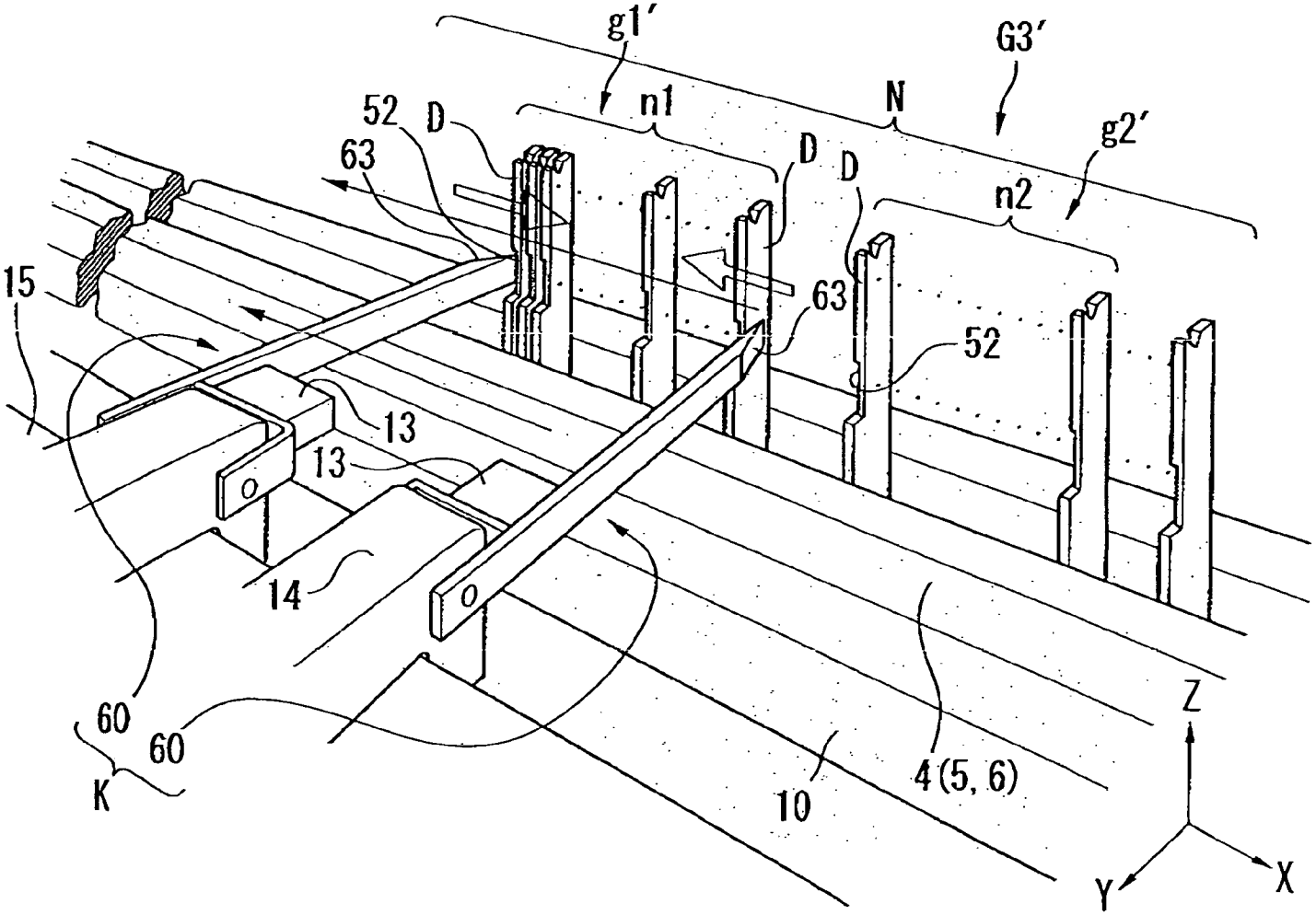
FIG. 24 is a diagram illustrating another tool-tilt prevention apparatus according to the invention.

FIG. 24 is a diagram illustrating another tool-tilt prevention apparatus according to the invention.

In FIG. 24, one tool group G3' comprising a predetermined number N of molds having the same shape and the same length is attached to the tool holder 4 (5, 6) of the lower table 10.

In this condition, after the leading end section 63 of the left separator 60 has been inserted into the separator-insertion groove 52 of the leading tool D of the tool group g1' comprising the predetermined number n1 of tools, and the left side of the tool group g1' has been contacted to the leading end 63, the leading end section 63 of the right separator 60 has been inserted into the separator-insertion groove 52 of the lead tool D of the right mold group g2 comprising the predetermined number n2 of tools, and the right side of the tool group g1' is pressed leftward.

Accordingly, because the two separators 60 sandwiches the tool group g1' from both sides, if the two separators 60 are moved leftward, e.g. at the same speed, the tool group g1' is split from the tool group g2' and moves leftward along with the movements of that separators, and is positioned at the predetermined position.

In this case, as the tool group g1' moves while being sandwiched by the two separators 60, the individual tools constituting the tool group g1' are firmly contacted one another and fixed during that movement by pressing force from the two separators 60, and accordingly, the individual tools do not tilt but keep the upright conditions during that movements.

The two separators 60 illustrated in FIG. 24 constitute both-sides sandwiching and positioning device K, that is, device of positioning the tool group g1' comprising the predetermined number n1 of tools at the predetermined position while sandwiching it from both sides, but like this embodiment, it is not necessary to use the driving mechanism of the abutment 13, and the separators may have an independent driving mechanisms.

Regarding the tool-tilt prevention apparatus (FIG. 20 to FIG. 24), the dies D side has been explained in detail, but the same is true of the punches P side, and the explanation thereof will be thus omitted.

Figure 25:
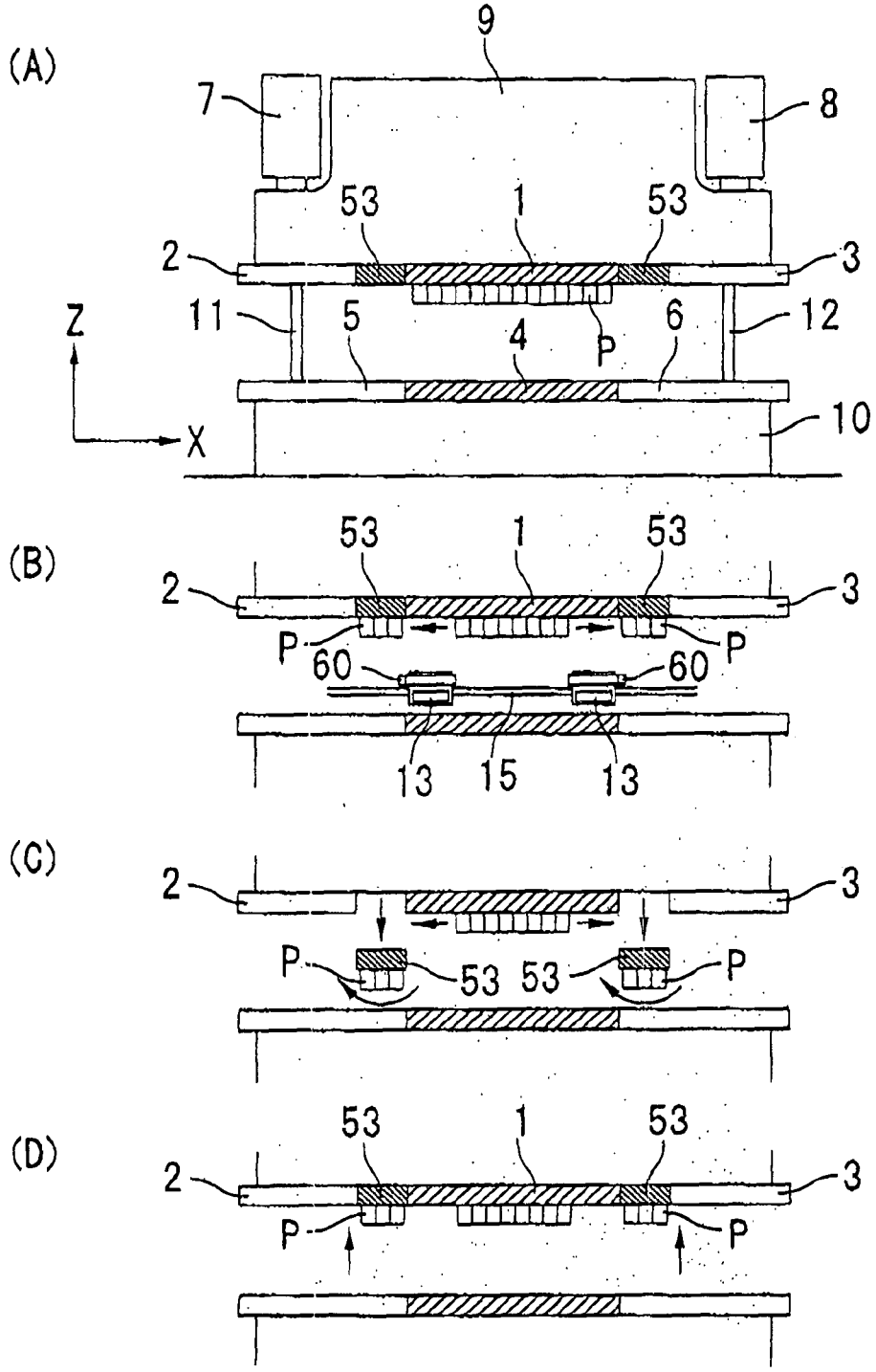
FIG. 25 is a diagram illustrating tool-turning-over operation according to the invention.

FIG. 25 is a diagram illustrating tool-turning-over operation according to the invention.

In FIG. 25(A), for example, conventional tool-turning-over mechanisms 53 are incorporated into the fixed tool holders 2, 3 at both ends of the upper table 9, and in this condition, some tools P from the tool group attached to the center of the upper table 9 for each attachable/detachable tool holder 1 is moved to the tool-turning-over mechanisms 53 with the separators 60 (FIG. 25(B)).

In this condition, the tool-turning-over mechanisms 53 are moved downward (FIG. 25(C)), turned over at 180 degree, moved upward (FIG. 25(D)), and attached to the fixed tool holders 2, 3 again, the tools P becomes the tools P whose shapes are turned over 180 degree from the original conditions (FIG. 25(B)) (for example, if the original condition is the goose-neck type in FIG. 19(B), it becomes the 180-degree-reversed goose-neck type), and bending is performed without interfering with the workpiece W.

The explanation has been given of the case where the tools with the same length (for example, 5 mm) and the same shape (for example, straight-sword type (FIG. 19(A)) are housed in the tool housing device A (FIG. 3) for each tool holder 1, as an example.

The invention, however, is not limited to that case, and can be applied to a case where the tools with different lengths (for example, 5 mm, 10 mm, 15 mm, 20 mm, 30 mm, 100 mm, 150 mm) and different shapes (straight-sword type (FIG. 19(A)) and goose-neck type (FIG. 19(B)) are housed in the tool housing device A for each tool holder 1.

Figure 26:
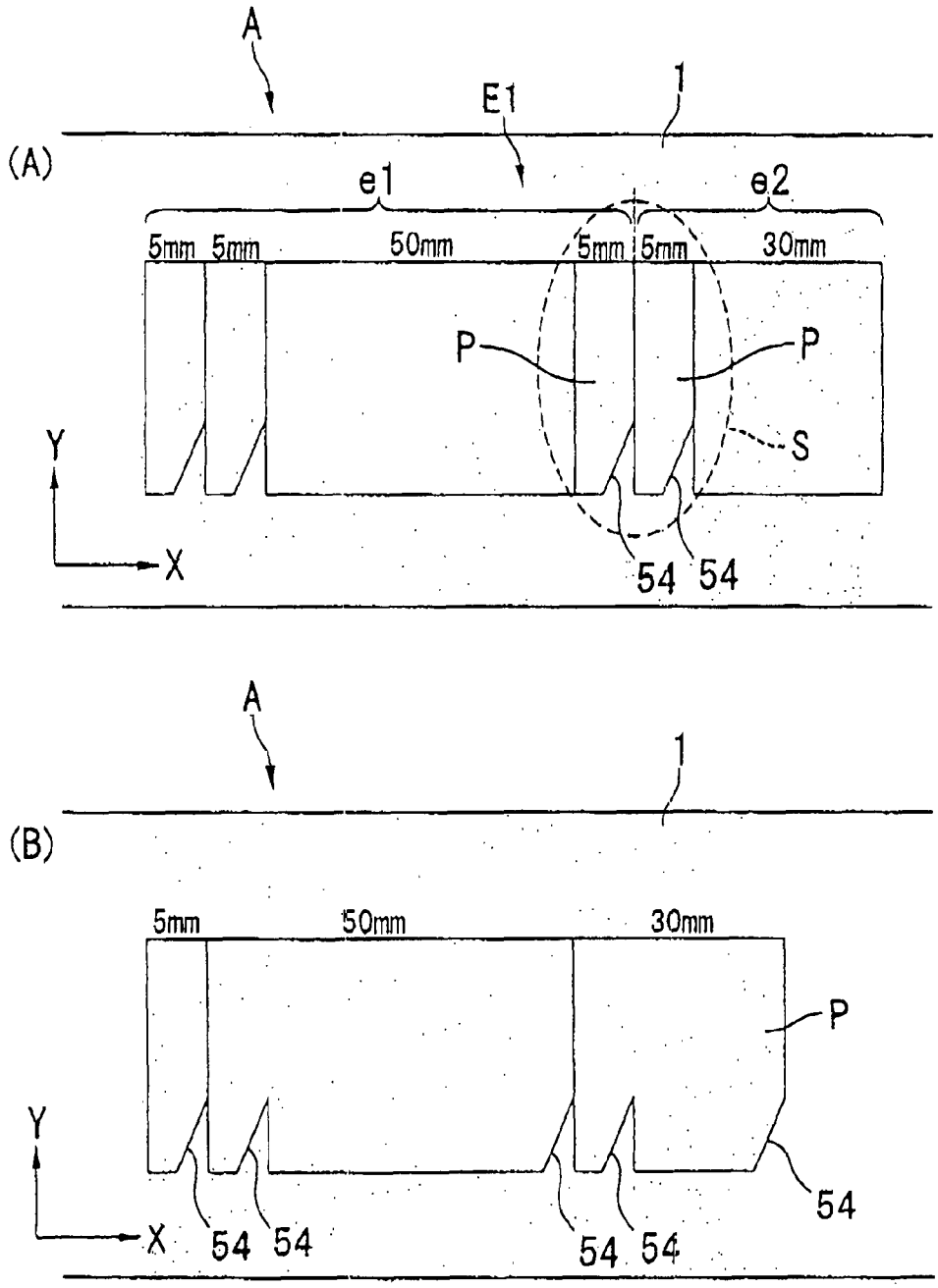
FIG. 26 is a diagram illustrating examples of combination of uneven molds and layout thereof.

FIG. 26 illustrates examples of a combination and a layout of the different molds P with different lengths (for example, 5 mm, 30 mm, and 50 mm) and different shapes (for example, straight-sword type and goose-neck type), and in the tool housing device A (corresponding to FIG. 3), the tools P with the different lengths are housed for each tool holder 1.

In FIG. 26(A), a tool group E1 comprising a plurality of split tools with different lengths and different shapes are housed in the tool holder 1, and if the tool group E1 is transferred to the upper table 9 for each tool holder 1 (FIG. 27) and split into a plurality of tool groups e1 (for example, constituted by the straight-sword type tools), e2 (for example, constituted by the goose-neck type tools), and the tools are combined and laid out in such a way that 5 mm of the two split tools P are always laid out at a separation portion S between the tool groups e1 (FIG. 26(A)) and e2.

In this case, a notch 54 where a fork-like separator 60 (FIG. 27 to FIG. 30) to be discussed later enters is formed in the split punch P.

According to the combination and layout of the split tools, it is not necessary to form the notch 54 in the tool with the other different lengths, resulting in simplification of the entire structure of the tool group and reduction of a cost because of reduction of a process cost of the notch 54.

Because of the structure, when the tool group E1 (FIG. 26(A)) is transferred from the tool housing device A to the upper table 9 through the tool exchanging device B (for example, FIG. 4) (FIG. 27(A)), the process-station formation device C comprising the fork-like separator 60 to be discussed later holds the split tools P at the right of the separation portion S (FIG. 27(B)) by sandwiching that tools.

This results in splitting of the tool group E1 into the plurality of mold groups e1, e2, and the fork-like separator 60 (FIG. 27(C)), which moves rightward (X-axial direction), positions, for example, the tool group e2 of the plurality of tool groups e1, e2 at the fixed tool housing 3 side of the upper table 9, thereby forming a plurality of process station $ST_1$, $ST_2$.

FIG. 28(B) is for a case where all tools P are provided with the notches 54, and this results in elimination of restriction of a placing position of the 5 mm split punch P, as different from the case of FIG. 26(A).

As described above, the tool group comprising the plurality of split tools with the different lengths and the different shapes are housed in the tool housing device A for each mold holder (for example, FIG. 26), and then a bending order, a mold, and a tool layout (process station) are determined based on product information (for example, CAD information).

When a process station is determined to cope with step bending easily and rapidly for a product particularly requiring a quality, tools with lengths close to the length of the process station are preferentially selected, and the length of the process station is formed by the less number of split tools as many as possible, so as to prevent generation of a scratch in a workpiece at the time of bending.

For example, according to the example in FIG. 26(A), in a case where the length of the process station $ST_2$ to be formed conclusively is 35 mm (corresponding to the length of the tool group e2 in FIG. 26(A)), a 30 mm tool is preferentially selected, and one 5 mm mold covers the remaining 5 mm, thereby forming the process station $ST_2$ by the total of two split tools.

In an another example case where the length of the process station is 200 mm, a 150 mm tool is preferentially selected, and 20 mm and 30 mm of two tools deal cover the remaining 50 mm, thereby forming the process station from the three split tools.

In this case, if information regarding which part of the tool holder 1 provided on the multiple racks (first racks 22, 23 to fourth racks 28, 29) on the rear face of the upper table 9 (FIG. 3), how long, what kind of shape, and how many split tools are housed in, is stored in a tool-holder database of the NC apparatus beforehand, predetermined combination and layout (for example, FIG. 26(B)) can be automatically or manually determined based on product information, thus forming a desired process station as described above (FIG. 27).

As mentioned above, in the tool holder 1 of the tool housing device A, the split tools necessary for forming a process station are combined and laid out based on the product information, and this combination and this layout are automatically or manually determined as stated above.

Therefore, the invention makes it possible to easily and rapidly cope with step bending to a product requiring a quality.

Figure 27:
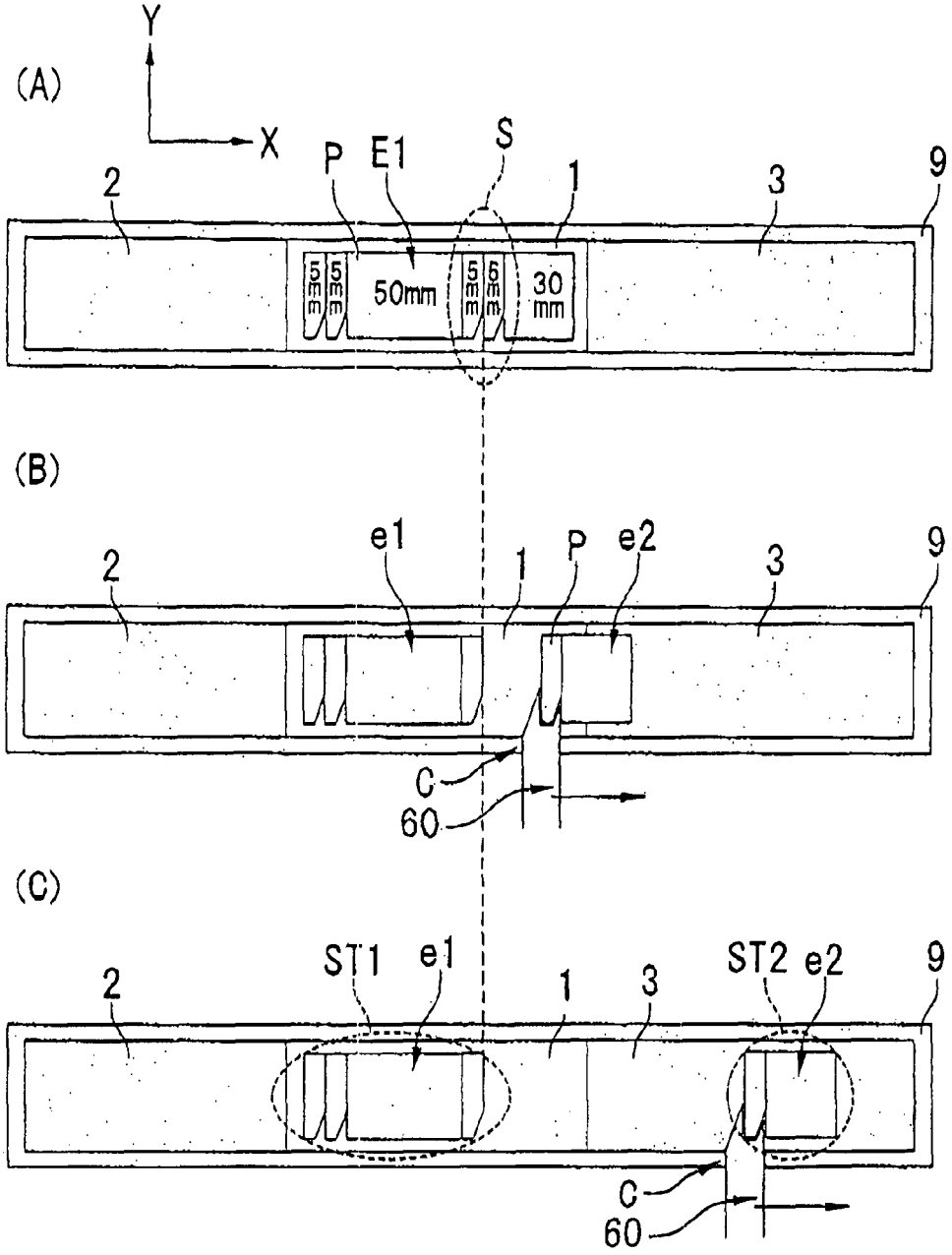
FIG. 27 is a diagram illustrating an example of process-station formation in the case of FIG. 26.
Figure 28:
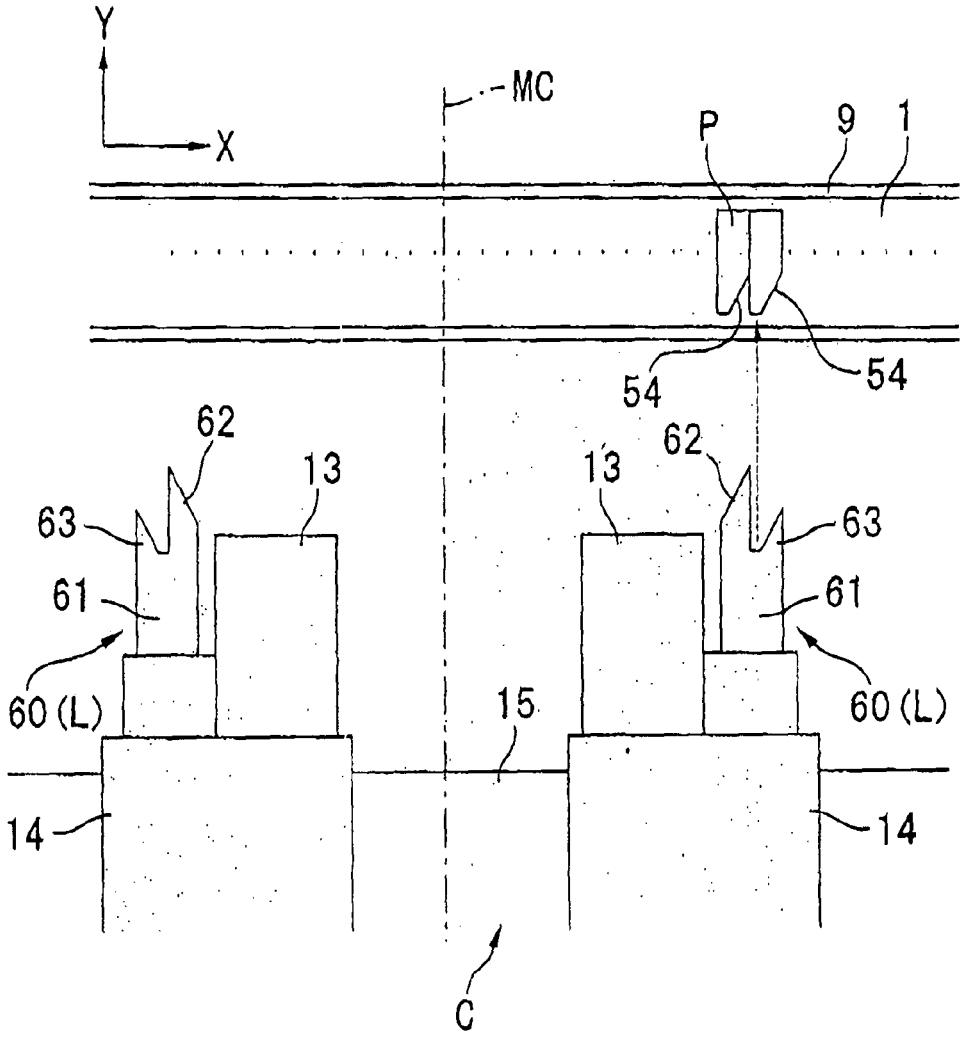
FIG. 28 is a diagram illustrating another example of the process-station formation device C according to the invention.

In this case, the process-station formation device C comprises the fork-like separator 60 as schematically illustrated in FIG. 27.

That is, the leading end of the separator 60 constituting the process-station formation device C (FIG. 28) is formed in a shape like a fork, and comprises a pair of tapered crows 62, 63 as illustrated in the figure.

When the lengths of the pair of tapered crows 62, 68 are compared with each other, the tapered crow 62 closer to the abutment 18 is longer (for example, it is approximately 2 mm longer than the tapered crow 63 far from the abutment 13).

Figure 29:
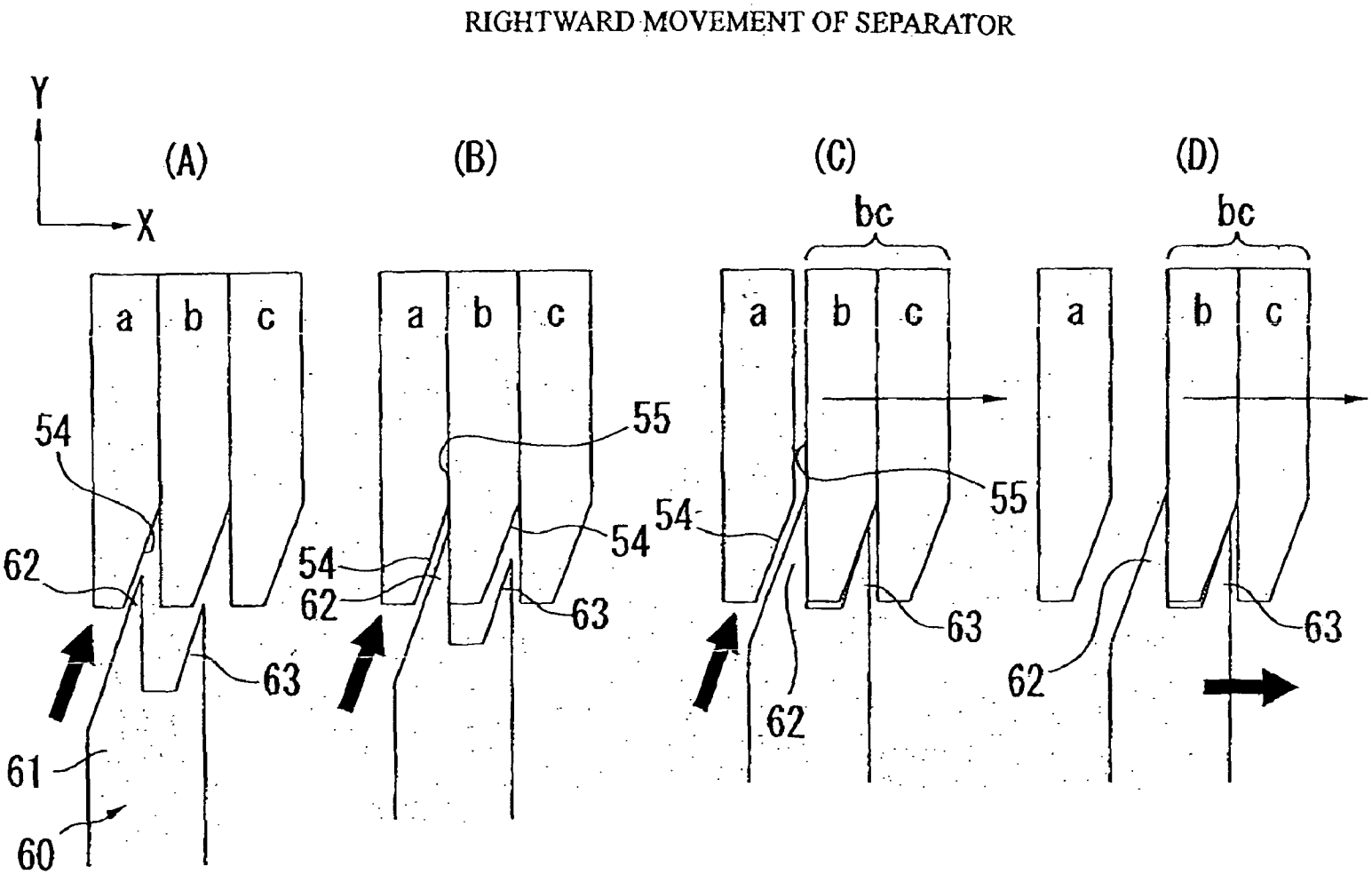
FIG. 29 is an explanatory diagram of the first operation of FIG. 28.
Figure 30:
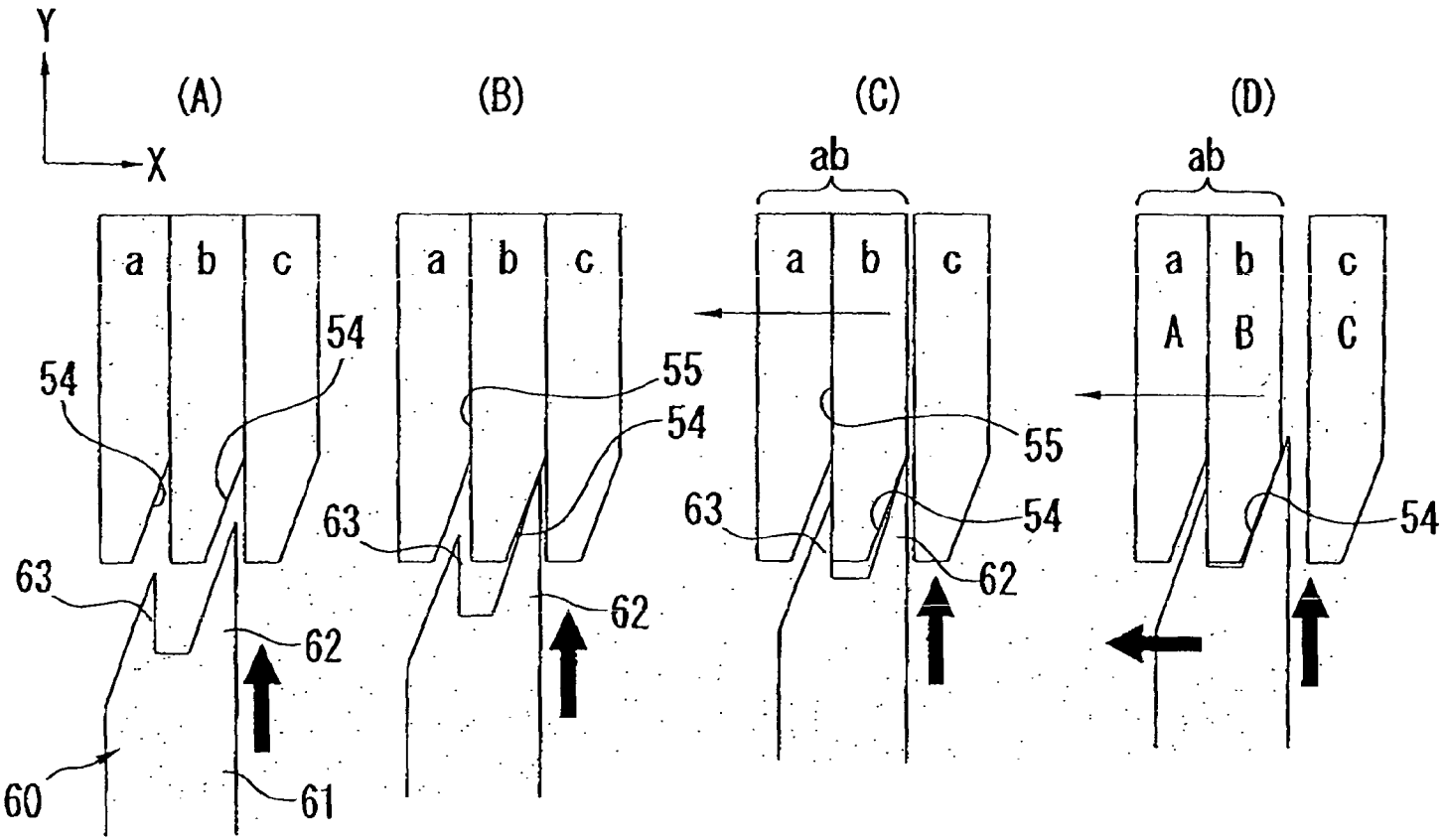
FIG. 30 is an explanatory diagram of the second operation of FIG. 28.

According to this structure, as the pair of the tapered crows 62, 68 sandwich and hold the 5 mm punch P (FIG. 27(B)) on the left of the tool group e2 of the plurality of tool groups e1, e2 constituting the tool group E1 transferred from the tool housing device A (FIG. 26(A)) to the upper table 9 (FIG. 27(A)) for each tool holder 1, a space is formed between both tool groups e1, e2, and they are split to discussed later (FIG. 29, FIG. 30).

In this condition, when the separator 60 is moved rightward, the tool group e2 can be moved to and positioned at, for example, the fixed tool holder 3 side of the upper table 9, as described above (FIG. 27(C)), and this enables formation of the desired plurality of process stations $ST_1$ and $ST_2$.

Because the separator 60 holds the punch P by sandwiching it in this manner, the tool group including the punch P can be moved to the predetermined position in an extremely stable condition, a tool-tilt preventive effect can be obtained even if, for example, the recess portions 50 and the protrusions 51 (FIG. 21, FIG. 22) are not provided.

In other words, the fork-like separators 60 (FIG. 28) constitute tool-sandwiching-holding-and-positioning device L of the tool tilt prevention apparatus.

Hereinafter, an explanation will be given of the operation of the fork-like separator 60 constituting the tool-sandwiching-holding-and-positioning device L with reference to FIG. 29 (a case where a tool group to be moved is at the right of a machine center MC (FIG. 28)), and FIG. 30 (a case where the tool group to be moved is at the left of the machine center MC (FIG. 28)).

In FIG. 29, when the fork-like separator 60 is moved frontward (Y-axial direction), and moved obliquely to come close to a tool group abc by biaxial movement (X-axial direction and Y-axial direction) in a condition in FIG. 29(A), a left side face 55 and the slit 54 of a central tool b are inserted between the pair of tapered crows 62, 63 of the fork-like separator 60 (FIG. 29(B)), and a clearance between the tapered crows 62, 68 and a tool b gradually becomes small.

In this condition, when the fork-like separator 60 is further moved obliquely (FIG. 29(C)), the pair of tapered crows 62, 63 slightly moves a tool group bc comprising the tool b and an adjacent tool c to the right while holding only the tool b by sandwiching it, and thus a space is formed between the tool group bc and the tool a as illustrated in the figure.

Therefore, as the separator 60 (FIG. 29(D)) is then moved rightward (X-axial direction), the tool b held by the tapered crows 62, 63 in a sandwiched manner pushes the adjacent tool c, and only the tool group bc is moved rightward as to be away from the tool a, and is positioned at a predetermined position.

In FIG. 30, when the fork-like separator 60 moves frontward (Y-axial direction) and approaches the tool group abc in a condition in FIG. 30(A), the slit 54 and left side face 55 of the central tool b are inserted between the pair of tapered crows 62, 63 of the fork-like separator 60 (FIG. 30(B)), and a clearance between the tapered crows 62, 63 and the tool b gradually becomes small.

In this condition, when the fork-like separator 60 is further moved frontward (FIG. 30(C)), the pair of tapered crows 62, 63 slightly moves a tool group ab comprising the tool b and an adjacent tool a to the left while holding only the mold b by sandwiching it, and a space is formed between the tool group ab and the tool c as illustrated in the figure.

Therefore, as the separator 60 (FIG. 30(D)) is slightly moved frontward and then moved leftward (X-axial direction), the tool b completely held by the tapered crows 62, 63 in a sandwiched manner pushes the adjacent tool a, and only the tool group ab is moved leftward as to be away from the tool c, and is positioned at a predetermined position.

FIG. 1 to FIG. 25 has explained a case where all of the split tools constituting the tool group have the same length in detail, but the invention is particularly effective when the lengths of all split tools are 5 mm because of the following reasons.

That is, the length of a split tool in the conventional tool market is generally 5 mm, 10 mm, 15 mm, 20 mm or the like, but manufacturing of a wide variety of products in small quantities nowadays becomes popular, and a user carries out bending by combining the those lengths of split tools appropriately in each case to cope with various bending lengths.

In such an environment, in a case of a bending length such as 35 mm or 105 min with the last number of 5 mm, a 15 mm split tool among the above-described lengths of the tools is used to form a predetermined bending length.

Therefore, opportunities where the 15 mm tool is frequently used increase, resulting in the lack of the 15 mm tool, and at the same time, this causes a problem such that a process cannot be performed by forming a plurality of process stations with the 15 mm split tools.

As a result, the process cannot be done at one time, and a new process station must be formed by exchanging all tool groups to do process, thus lowering a process efficiency.

Figure 31:
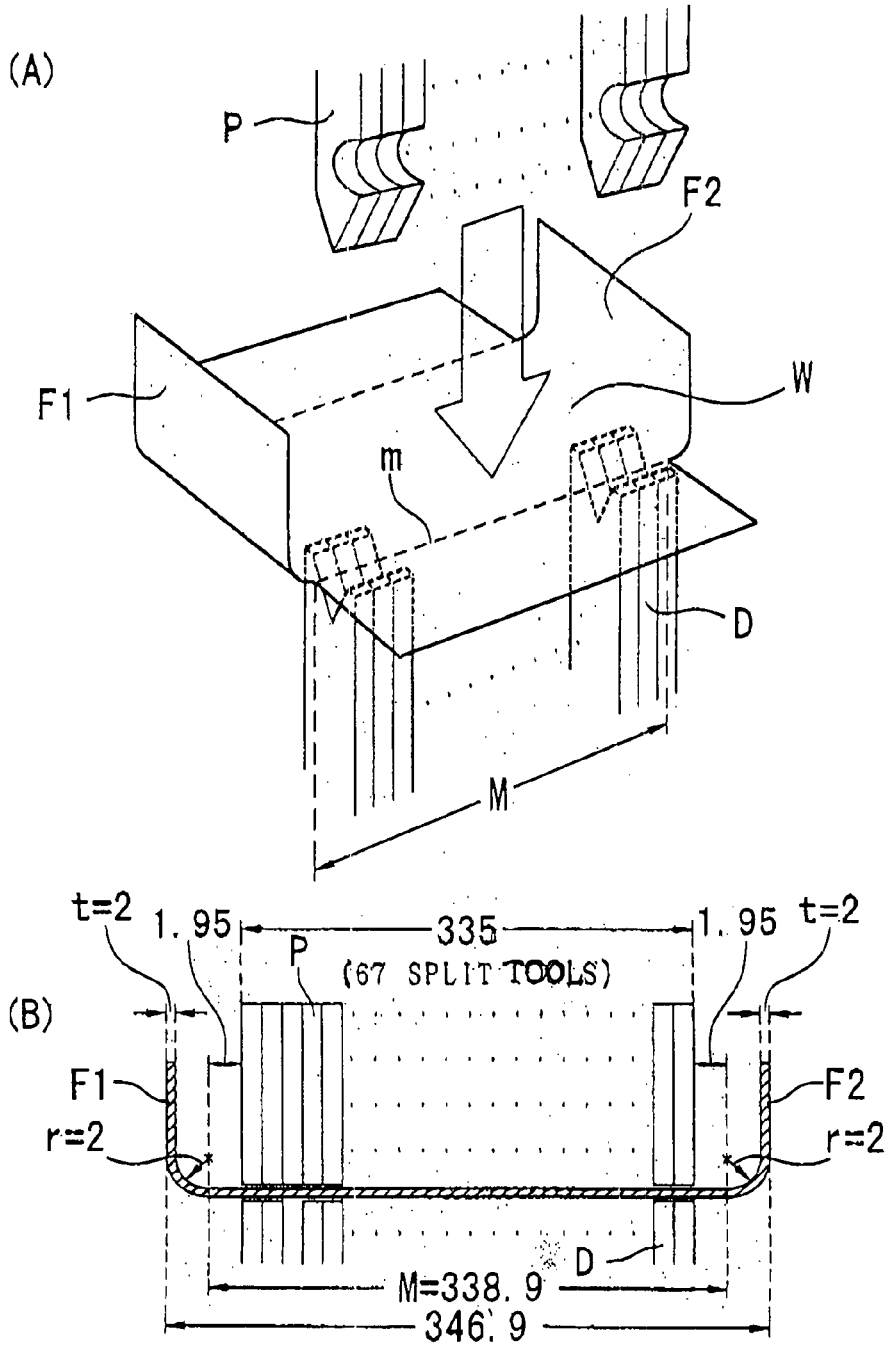
FIG. 31 is a diagram explaining the reason why 5 mm split tools are effective according to the invention.

Moreover, in a case where a workpiece W with which flanges $F_1$ (FIG. 31(A)), $F_2$ are already formed is processed along a binding line m, if the external size of the workpiece is 346.9 mm (FIG. 31(B)), a plate thickness t=2 mm, and a bending radius r=2 mm, a proper bending length M becomes like 346.9 mm−(2+2+2+2) mm=338.9 mm.

However, the above-described conventional split tools cannot form the bending length M=338.9 mm, and a 335 mm tool group must be formed by 67 split tools with 5 mm lengths (5 mm×67), and the process must be performed on the workpiece W along the bending line m by that 335 mm tool group.

In this case, as illustrated in the figure, it is out of a tool corresponding to the length of 338.9 mm−335 mm=3.9 mm, and because clearances each having a length of 1.95 mm are formed on both sides, the corners are rounded, resulting in detraction from a quality.

As mentioned above, however, if the clearance at one side is 1.95 mm and less than 2 mm, the clearance as little as that level can maintain the quality.

In a case where the bending length with the 5 mm last number is formed, because a 15 mm split tool lacks as described above, and to cope with various bending lengths, 5 mm tools must be used for improving the process efficiency.

By using the 5 mm split tools (FIG. 31), even if the proper bending length M cannot be obtained, and a clearance is formed between the proper bending length M and the tool group, the quality of a finished product is possibly maintained when the clearance at one side is less than 2 mm.

Because of those reasons, according to the invention, in a case where all of the split tools constituting a tool group have the same length, it is effective to set the same length at 5 mm.

Figure 32:
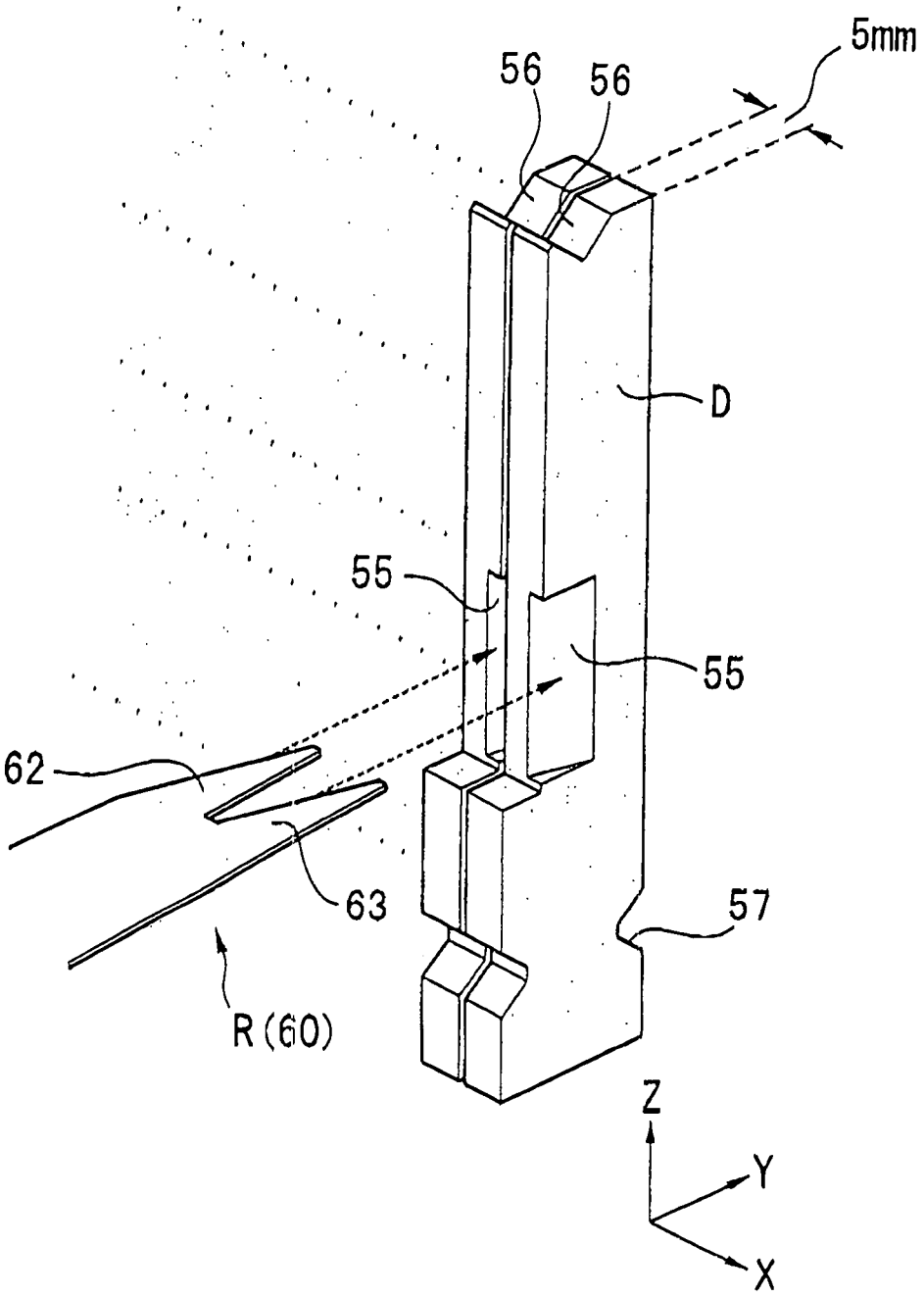
FIG. 32 is a diagram illustrating 5 mm split tools according to the invention.

FIG. 32 illustrates the shapes of 5 mm split tools D.

The illustrated tool D has, for example, a V groove 56 as a process portion on the top, and clamp portions 57 (FIG. 32) with respect to the tool holder 4 (5, 6) (FIG. 1) adjacent to the bottom.

A groove 55 with which tool moving and positioning device R can freely engage is provided between the V groove 56 and the clamp portions 57.

The groove 55 is provided at the abutment 13 side (for example, FIG. 28) as the rear face of the mold D, and the groove 55 is formed in a tapered shape as illustrated in the figure.

The tool moving and positioning device R comprises, for example, the fork-like separator 60, and the leading end thereof is provided with the tapered member, and the pair of the tapered crows 62, 63 are an example of the tapered member.

According to this structure, when the pair of tapered crows 62, 63 of the tool moving and positioning device R (FIG. 32) is engaged with the groove 55 of the mold D, the pair of the tapered crows 62, 63 hold the tool D at the near side by sandwiching it.

Therefore, when the tool moving and positioning device R is moved, for example, leftward (X-axial direction), the tool group comprising the plurality of 5 mm split tools can be moved leftward, and positioning the tool group at a predetermined position enables formation of the plurality of process stations (for example, FIG. 16(D)). The tool moving and positioning device R is not limited to the embodiment which uses the back gauge, and a robot for a bending apparatus may be used.

FIG. 32 illustrates the structure of the dies D side, but the structure of the punches P side is exactly the same as that, and a groove 55 with which the tool moving and positioning device R can engage is provided at the back gauge side (rear) between the leading end as the bending section of the punch P and a clamp tool group rightward and leftward with a jig for moving the tool groups instead of the tool moving and positioning device R, the groove 55 may be provided at the worker's side (front).

As described above, according to the invention, because it is possible to cope with various bending lengths by constituting a tool group with a plurality of split tools all having lengths of 5 mm without using the deficient 15 mm split tool, the plurality of process stations can be built rapidly, and this makes it possible to cope with step bending easily and rapidly.

In the above-described embodiment, the explanation has been given of the case where the tool group comprising the plurality of split tools is transferred to the upper and lower tables for each tool holder from the tool housing device (FIG. 1 to FIG. 6), and then the plurality of process stations are formed, but the present invention is not limited to this, and the tool group can be transferred to the upper and lower tables from the tool housing means provided at the side of a machine body without using the tool holder.

INDUSTRIAL APPLICABILITY

The invention is used by a bending apparatus, a bending method, and a bending tool which improve a process efficiency and save a tool housing space by easily and rapidly coping with step bending, and in particular, applied to not only a lifting-down type press brake which lowers an upper table, but also a lifting-up type press brake which elevates a lower table, and further, it is effective for a case where a desired process station is formed by housing not only a tool group comprising a plurality of split tools with the same length and the same shape, but also a tool group comprising a plurality of split tools with different lengths and different shapes, and in particular, effective for a bending apparatus, a bending method and a bending tool in which all of tools constituting a tool group having lengths of 5 mm.

The invention claimed is:

1. A bending apparatus which moves one of upper and lower tables, and performs bending on a workpiece with tools attached to said upper and lower tables, said upper and lower tables having a longitudinal axis, the bending apparatus comprising:

a tool-layout information determination device for automatically or manually determining tool-layout information based on product information;

a tool housing device for housing tool holders each for holding a tool group including a plurality of split tools;

a tool exchanging device for exchanging the tool holders with their tool groups of the split tools between said tool housing device, and said upper and lower tables, the dimension of the tool holders extending in the longitudinal direction of the tables being less than the longitudinal dimension of the tables; and a process-station formation device for splitting a tool group transferred from said tool housing device to said upper and lower tables through said tool exchanging device into a plurality of tool groups based on said tool-layout information from said tool-layout information determination device, thereby forming a plurality of process stations, the process-station formation device being capable of moving ones of the split tools, that were transferred to said upper and lower tables, in the longitudinal direction of the tables to positions on the upper or lower tables not in the tool holders.

2. The bending apparatus according to claim 1, wherein all of said plurality of split tools have the same length.

3. The bending apparatus according to claim 2, wherein all of said plurality of split tools have a length of 5 mm.

4. The bending apparatus according to claim 1, wherein a combination and layout of the split tools necessary for forming the process stations predetermined based on the product information are formed in one of the tool holders of said tool housing device.

5. The bending apparatus according to claim 4, wherein said combination and layout of the split tools necessary for forming the process stations are automatically or manually determined.

6. The bending apparatus according to claim 1, wherein said tool housing device is constituted by multistage racks mounted up and down on a rear face of said upper and lower tables, and said multistage racks house said plurality of split tools, for each tool holder.

7. The bending apparatus according to claim 1, wherein said tool exchanging device is constituted by holder hold members for holding a tool holder, and said holder hold members are movable frontward, backward, upward and downward between said tool housing device and said upper and lower tables.

8. The bending apparatus according to claim 1, wherein said process-station formation device comprises a separator, and said separator is movable rightward, leftward, frontward, backward, upward and downward.

9. The bending apparatus according to claim 8, wherein said separator has an arm which is rotatably mounted on an abutment of a back gauge.

10. The bending apparatus according to claim 1, wherein said process-station formation device comprises a fork-like separator, and said fork-like separator has a pair of taper claws.

11. The bending apparatus according to claim 1, wherein the exchangeable tool holders are freely attachable and detachable tool holders that are mounted to the center of said upper and lower tables, to whose both sides fixed tool holders are mounted, and holder clamp members for fixing said freely attachable and detachable tool holders are mounted in the center said upper and lower tables.

12. The bending apparatus according to claim 11, wherein tool clamp members for supporting and fixing the desired tool group are mounted in said freely attachable and detachable tool holders and said fixed tool holders.

* * * * *